US010245752B2

(12) United States Patent
Zeno et al.

(10) Patent No.: US 10,245,752 B2
(45) Date of Patent: Apr. 2, 2019

(54) CHAINSAW BAR SHIELD

(71) Applicants: Tom J. Zeno, Uniontown, OH (US); Michele S. Zeno, Uniontown, OH (US)

(72) Inventors: Tom J. Zeno, Uniontown, OH (US); Michele S. Zeno, Uniontown, OH (US)

( * ) Notice: Subject to any disclaimer, the term of this patent is extended or adjusted under 35 U.S.C. 154(b) by 0 days.

(21) Appl. No.: 15/604,107

(22) Filed: May 24, 2017

(65) Prior Publication Data

US 2018/0339423 A1 Nov. 29, 2018

(51) Int. Cl.
*B27G 19/00* (2006.01)
*B27B 17/02* (2006.01)

(52) U.S. Cl.
CPC ..... *B27G 19/003* (2013.01); *B27B 17/02* (2013.01)

(58) Field of Classification Search
CPC ..... B27G 19/003; B27B 17/02
USPC ..... 30/382
See application file for complete search history.

(56) References Cited

U.S. PATENT DOCUMENTS 2,693,724 A 11/1954 Currie
2,824,469 A 2/1958 Craig
2,925,105 A * 2/1960 Hayden ..... B27B 17/0016 30/371
2,930,416 A * 3/1960 Granberg ..... B27B 17/0083 30/371
3,754,328 A * 8/1973 Knerr ..... B27B 7/02 30/382
3,768,363 A * 10/1973 Tackett ..... B23C 1/20 144/136.95
3,808,684 A * 5/1974 Ludwig ..... A01G 3/08 30/371
4,063,358 A * 12/1977 Hodge ..... B27G 19/003 30/371
4,109,900 A 8/1978 Vandecoevering
4,143,460 A * 3/1979 Shean ..... B27G 19/003 30/151
4,248,412 A 2/1981 DeRoy
4,283,980 A 8/1981 Jackson
4,447,953 A 5/1984 Lombardino et al.
4,657,234 A 4/1987 Stout
4,683,780 A 8/1987 Robison
4,833,781 A * 5/1989 Allen ..... B27B 17/0083 30/377
4,907,778 A 3/1990 Rockwell
5,119,937 A 6/1992 Reynolds, Jr.
5,156,156 A * 10/1992 Ruzich ..... B27B 17/0083 30/382
5,269,064 A * 12/1993 Greene ..... B27G 19/003 30/371
5,395,100 A 3/1995 Stienbarger
(Continued)

*Primary Examiner* — Hwei-Siu C Payer
(74) *Attorney, Agent, or Firm* — Hahn Loeser & Parks LLP

(57) ABSTRACT

Examples herein include a chainsaw bar shield and a method for using a chainsaw bar shield. A chainsaw bar shield comprises a bar shield arm extending from at least one securing mechanism for engaging and pinching a chainsaw bar extending from a chainsaw housing. The securing mechanism offsets the bar shield arm from a chainsaw chain extending from the chainsaw housing and, thereby, protects a user by separating the user from the chainsaw chain during maintenance of a chainsaw. Other examples of a chainsaw bar shield comprise an enclosure secured to a chainsaw bar which is offset from and substantially encloses a chainsaw chain extending from a chainsaw housing.

20 Claims, 21 Drawing Sheets

(56) References Cited

U.S. PATENT DOCUMENTS

| | | | | |
|---|---|---|---|---|
| 5,435,065 | A * | 7/1995 | Raczykowski | B27B 17/0083 30/382 |
| 5,669,145 | A * | 9/1997 | Skripsky | B27B 17/0083 30/371 |
| 5,671,537 | A * | 9/1997 | Dofredo | A01G 3/053 29/740 |
| 5,816,118 | A | 10/1998 | Favinger | |
| 7,140,114 | B2 | 11/2006 | Shenker et al. | |
| 7,806,154 | B2 | 10/2010 | Yang | |
| 2002/0162441 | A1 | 11/2002 | Dumas | |
| 2011/0146086 | A1* | 6/2011 | Palmer | B27B 17/0083 30/382 |
| 2011/0167649 | A1* | 7/2011 | Reed | B27B 17/00 30/371 |
| 2018/0339423 | A1* | 11/2018 | Zeno | B27B 17/02 |

* cited by examiner

CHAINSAW BAR SHIELD

BACKGROUND

Field

Examples described herein relate generally to a device and methods for protecting a user from the hazards of chainsaw maintenance, including the operating, diagnosing, repairing, and/or testing of a chainsaw.

Description of the Related Art

Protective devices and maintenance devices have been developed and used to protect a user from the dangers associated with chainsaw usage and maintenance of a chainsaw, respectively. Protective devices available for chainsaw usage limit accessibility to the components of a chainsaw during maintenance operations and are often removed during maintenance. Alternatively, maintenance devices limit or prevent operation of a chainsaw during maintenance activities, such as the operating, diagnosing, repairing, and/or testing of a chainsaw. As illustrated by the examples below, the available chainsaw protective devices would not be used during maintenance activities and the available chainsaw maintenance devices would not be used when operating a chainsaw. Therefore, a device and a method for protecting a user from the hazards of a chainsaw during maintenance, including operating, diagnosing, repairing, and/or testing, is needed.

One example of a chainsaw protective device is a chainsaw scabbard or sheath. A chainsaw scabbard or sheath is used to encase the chainsaw bar and chain extending from a chainsaw housing. The scabbard or sheath is slid over the exposed chainsaw bar and chain. The chainsaw scabbard or sheath is friction fitted onto the chainsaw bar and chain and engages or contacts the chainsaw bar and chain. Consequently, a chainsaw scabbard or sheath limits the maintenance of a chainsaw, such as when the engine of a chainsaw must be fired and/or operated to adjust or tune chainsaw components, such as a carburetor. Further, a chainsaw scabbard or sheath limits other maintenance which may require the chain to move freely, such as when the chain brake is not applied. Since chainsaw scabbards and sheaths are friction fit and are in contact with the chain, operating a chainsaw with a chainsaw scabbard or sheath will result in damage to the scabbard, sheath, and/or chainsaw. As such, a chainsaw scabbard or sheath is inadequate to protect a user from the hazards of a chainsaw during maintenance, including operating, diagnosing, repairing, and/or testing.

Another example of a chainsaw protective device is a chainsaw kickback guard. A chainsaw kickback guard is a protective device for use when operating a chainsaw. In particular, a chainsaw kickback guard is secured to a housing of the chainsaw, independent of the chainsaw bar and chainsaw chain. The chainsaw kickback guard is provided to separate the user of a chainsaw from the chain of the chainsaw, during the cutting operation, in the event the chainsaw bar and/or chainsaw chain jumps from the working position toward the user. However, as noted above, a chainsaw kickback guard is not attached to the chainsaw bar or chain and is, instead, secured to the chainsaw housing. Therefore, in order to access the components of the chainsaw located at or within the chainsaw housing, the chainsaw kickback guard is an impediment or must be removed for maintenance. Since a chainsaw kickback guard is inadequate and an obstacle for performing maintenance on a chainsaw, and in particular, the components of the chainsaw located at or within the chainsaw housing, an improved protective device for the maintenance of a chainsaw is needed.

One example of a chainsaw maintenance device is a chainsaw vise. A chainsaw vise is used to secure a chainsaw into a maintenance position allowing force to be applied to the chainsaw. However, the particular hazards as identified in the present disclosure are not adequately reduced or eliminated. In particular, a chainsaw vise may fasten to a chainsaw bar to secure and support the chainsaw for freely moving the chain and sharpening the chain. A chainsaw vice, however, does not protect a user from the dangers of a chainsaw chain since the chainsaw vice maintains access to the chain. Moreover, since a chainsaw vice keeps the chainsaw chain exposed the chainsaw vice is not designed for maintenance of a chainsaw which may further require the operation, diagnosing, and/or testing of the chainsaw. Therefore, since hazards remain when using a chainsaw vice, since the chainsaw vice is a maintenance device which sets out to maintain access to the chain, the chainsaw vice is inadequate as a protective device.

Since the current chainsaw maintenance devices and chainsaw protective devices are inadequate and cannot be combined and still maintain their original purpose an improved protective device for the maintenance of a chainsaw, including operating, diagnosing, repairing, and/or testing, is needed.

SUMMARY

Examples described herein relate generally to a chainsaw bar shield and methods for guarding a user from the dangers of a chainsaw during maintenance, including operating, diagnosing, repairing, and/or testing. Examples may include a chainsaw bar shield which separates a user from at least a portion of the chainsaw bar and/or chainsaw chain. These examples and other examples may include a fluid collection system and methods for collecting chainsaw fluid for reducing or eliminating the dangers of having chainsaw fluids in the working environment.

In an example of a chainsaw bar shield, the chainsaw bar shield comprises at least one bar shield arm extending from at least one securing mechanism. The at least one securing mechanism includes a pinching structure having a first engaging structure for engaging a first side of the chainsaw bar of a chainsaw and a second engaging structure for engaging a second side of a chainsaw bar where a pinch point is between the first engaging structure and the second engaging structure. In this example, the at least one bar shield arm is offset from the point where the at least one bar shield is offset from the pinch point and the at least one bar shield arm does not contact or engage the chainsaw bar and a chainsaw chain when the chainsaw bar shield is secured to the chainsaw. In some examples, the at least one bar shield arm may further comprise one or more lips. The one or more lips may extend around and conceal at least a portion of the chainsaw chain.

In some examples, an apparatus for collecting fluids from the chainsaw may be provided. In one example, the one or more lips may form a channel at the at least one bar shield arm. For collecting the fluids, the channel and/or the at least one bar shield arm may comprise a drain aperture and the drain aperture may extend to a reservoir.

The shape and the size of the at least one bar shield arm may vary. In an example, the at least one bar shield arm has a length which is greater than a length of the chainsaw bar which extends from a chainsaw housing.

In some particular examples, a plurality of chainsaw bar shield arms may be provided. In one particular example, a first bar shield arm, which does not contact or engage the bar and the chainsaw chain when the chainsaw bar shield is secured to the chainsaw, is provided in combination with a second bar shield arm, which additionally does not contact or engage the bar and the chainsaw chain when the chainsaw bar shield is secured to the chainsaw. An end arm may additionally be provided. The end arm is proximal, or offset from, a terminal end of the chainsaw bar. Similarly, the end arm does not contact or engage the chainsaw bar and the chainsaw chain when the chainsaw bar shield is secured to the chainsaw. One or more lips may additionally be provided at some or all of the plurality of arms.

In the examples of a chainsaw bar shield, the engaging structures may further comprise an advancing mechanism. In one example, either the first engaging structure or the second engaging structure of a pinching structure may comprise the advancing mechanism. In another example, both the first engaging structure and the second engaging structure may comprise an advancing mechanism. Further, the engaging structures may be formed of or comprise dampening material for reducing or eliminating any damage to the chainsaw.

In another example of a chainsaw bar shield, the chainsaw bar shield comprises an enclosure. The enclosure has an opening for inserting a chainsaw bar and a chainsaw chain. The chainsaw bar and the chainsaw chain which extends from the a chainsaw housing into the enclosure. The enclosure includes a first lateral arm, a second lateral arm, a top arm, a bottom arm, and an end arm for substantially enclosing the chainsaw bar and the chainsaw chain which extends from the chainsaw housing. The chainsaw bar shield includes at least one securing mechanism. The at least one securing mechanism includes a pinching structure having a first engaging structure for engaging a first side of the chainsaw bar and a second engaging structure for engaging a second side of the chainsaw bar at a pinch point. The at least one securing mechanism is secured to the enclosure for separating the enclosure from the chainsaw chain when the enclosure is substantially enclosing the chainsaw bar and the chainsaw chain which extends from the chainsaw housing. Similar the bar shield arms, the chainsaw enclosure may further comprise a channel, an aperture, and/or a reservoir for capturing fluids.

In some embodiments, the enclosure may further comprise an extension mechanism for adjusting the size, including the length, of the enclosure. The extension mechanism may also be provided to adjust the location of the securing mechanism on the chainsaw bar. In one particular example, the extension mechanism is a sliding mechanism.

BRIEF DESCRIPTION OF THE DRAWINGS

Reference is made to the accompanying drawings in which particular examples and further benefits of the examples are illustrated as described in more detail in the description below, in which.

DETAILED DESCRIPTION

Figure 1:
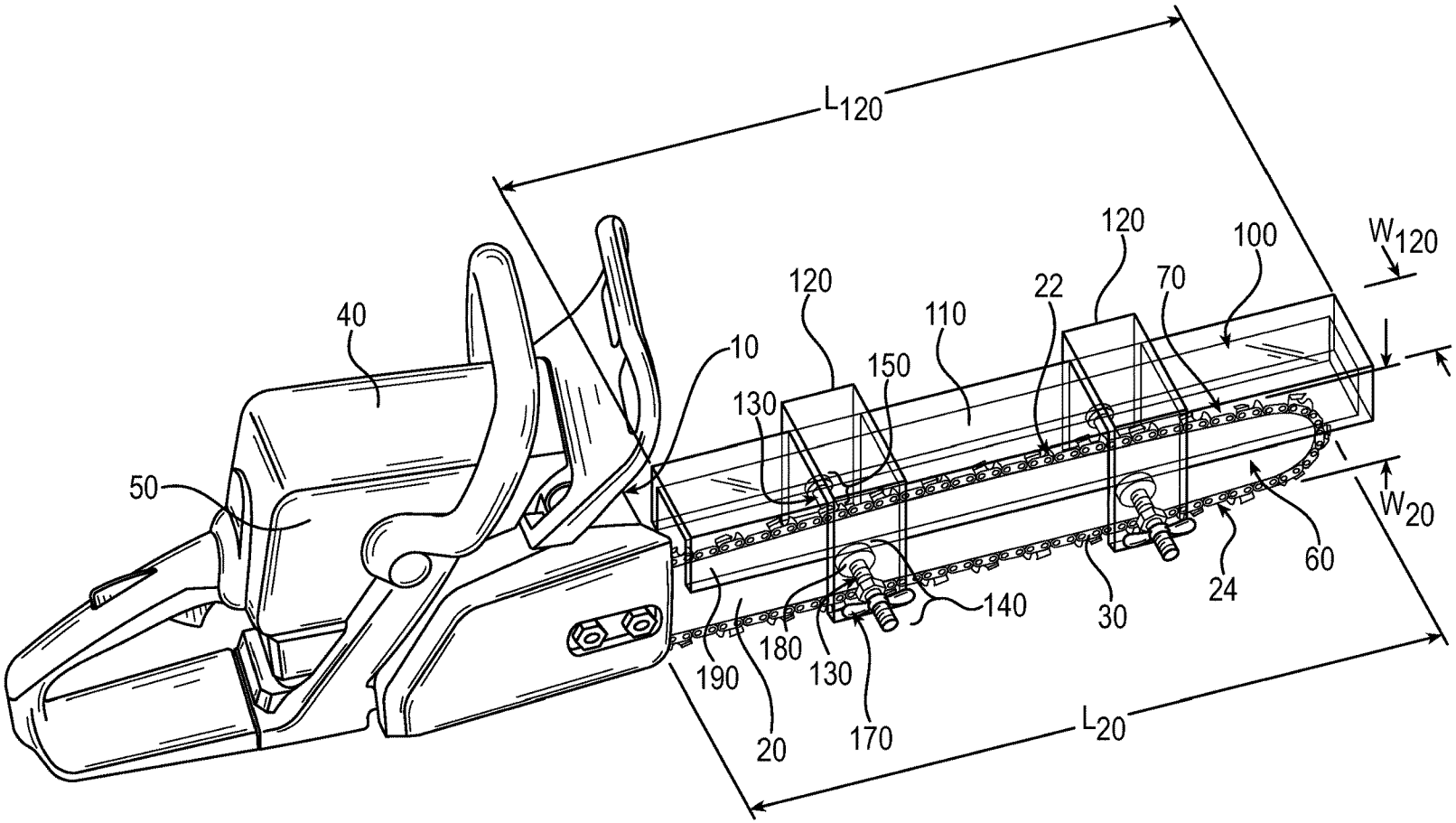
FIG. 1 is an isometric view of a chainsaw in a chainsaw bar shield, in accordance with an example.

Maintenance of a chainsaw includes many of the dangers inherent in the use of a chainsaw and, at times, increases the dangers. The increased danger may be a result of working on and in close proximity to the moving components of a chainsaw while performing maintenance on those components. As used with reference to the present examples, maintenance of a chainsaw includes the operating, diagnosing, repairing, and/or testing of a chainsaw. As described above, current devices do not, at least, provide for a chainsaw to be operated during maintenance in order to diagnose and test the chainsaw.

The examples herein may also be used while performing chainsaw product demonstrations. By example, in a product demonstration a crowd may be exposed to the dangers of a chainsaw by gathering around the chainsaw in an environment which may not, otherwise, eliminate the unnecessary risk to the user, the crowd, and even unsuspecting bystanders. It is worth noting that many manufacturers have established guidelines which require the chainsaw to have the chainsaw bar and chain attached to the power unit while running, otherwise, damage may occur to the motor due to insufficient load and/or over speeding. Therefore, it is not a reasonable solution to simply remove the chainsaw bar and/or chain in order to perform a demonstration and/or the necessary operating, diagnosing, and testing operations while maintaining a chainsaw. Moreover, since a chainsaw housing conceals many of the chainsaw components that require demonstration or maintenance, such as the power unit, it may be necessary to have access to and/or remove the chainsaw housing in order to complete the necessary maintenance, including operating, diagnosing, repairing, and/or testing.

The identified dangers may be present regardless of whether the chainsaw is operating. In particular, for a chainsaw to function at its peak performance, chainsaw chains are kept in an extremely sharp condition. Regardless of whether the chain is in motion, a cut risk is always present. Sharp chains are apparent dangers. Chainsaws also present additional dangers that may not be so apparent. For example, during operation, a chainsaw vibrates and, unless secure, may rotate when sitting on a surface. This vibration and/or rotation may result in a chainsaw turning toward other objects and projecting and/or damaging the chainsaw or the other objects. This contact may also cause damage to a chainsaw that may go unseen until a failure occurs during usage, thereby creating an increased risk even after maintenance is completed.

Other dangers may not be present at the chainsaw during maintenance but may result as a byproduct of operating, diagnosing, and/or testing the chainsaw. By example, chainsaws utilize many fluids. These fluids include fuel, engine oil, and bar oil. During operation, diagnosis, repairing, and/or testing, a user and the user's environment is exposed to the fluids. In particular, chainsaw bar oil is distributed to the chainsaw bar and chain from an automatic oiler for lubrication. The bar oil from the automatic oiler may coat a work surface, a floor surface, and even the user, thereby creating a slip hazard and/or an irritant.

In view of, at least, the above dangers, which may be present during maintenance, including operation, diagnosis, repair, and/or testing of a chainsaw, improved maintenance and protective methods and devices are needed. The present disclosure provides a chainsaw bar and chain protective device and method of its use. Examples of such a protective device are described, herein, as examples of a chainsaw bar shield. Examples of the chainsaw bar shield effectively cover the bar and chain in a manner that prevents body parts or other objects from coming into contact with the bar and chain, thus reducing injury and damage. In some examples, the chainsaw bar shield is configured, additionally or alternatively, to maintain a safe work environment by collecting the fluids, such as overspray of bar oil, which accumulates in a work environment during the operation of the chainsaw. Examples of a chainsaw bar shield also provide the user the flexibility to access the necessary components of a chainsaw requiring maintenance and/or operate the chainsaw while protecting the user from the dangers of the chainsaw.

Examples of the chainsaw bar shield will now be described in further detail below in association with the accompanying Figures.

With reference to FIG. 1, an isometric view of a chainsaw 10 positioned within a chainsaw bar shield 100 is illustrated. In this particular example, the chainsaw bar shield 100 is illustrated as transparent. The chainsaw comprises a chainsaw housing 40 with a chainsaw bar 20 extending therefrom. The chainsaw chain 30 also extends from the chainsaw housing 40 about the chainsaw bar 20. A chainsaw housing 40 may include and conceal a chainsaw power unit 50 and other mechanical components for operating the chainsaw 10. In this particular example, the chainsaw bar shield 100 comprises a bar shield arm 110 elevated above, and separated from, the chainsaw bar 20 and the chainsaw chain 30, or the top 22 of the chainsaw bar 20 where the top 22 of the chainsaw bar 20 is opposite the bottom 24 of the chainsaw bar 20, relative a chainsaw bar width $W_{20}$. The chainsaw bar shield 100 does not contact or engage the chainsaw chain 30. The chainsaw bar shield 100 further comprises a securing mechanism 120 attached to the bar shield arm 110 for positioning the bar shield arm 110 relative the chainsaw 10. The securing mechanism 120 includes a pinching structure 130 having a first engaging structure 140 and a second engaging structure 150. A pinch point 160 (illustrated in FIGS. 3-4) is located between the first engaging structure 140 and the second engaging structure 150. The chainsaw bar 20 is secured between the first engaging structure 140 and the second engaging structure 150 at the pinch point 160 by an advancing mechanism 170. The first engaging structure 140 and the second engaging structure 150 further comprise dampening material 180 for engaging the chainsaw bar 20.

Figure 2:
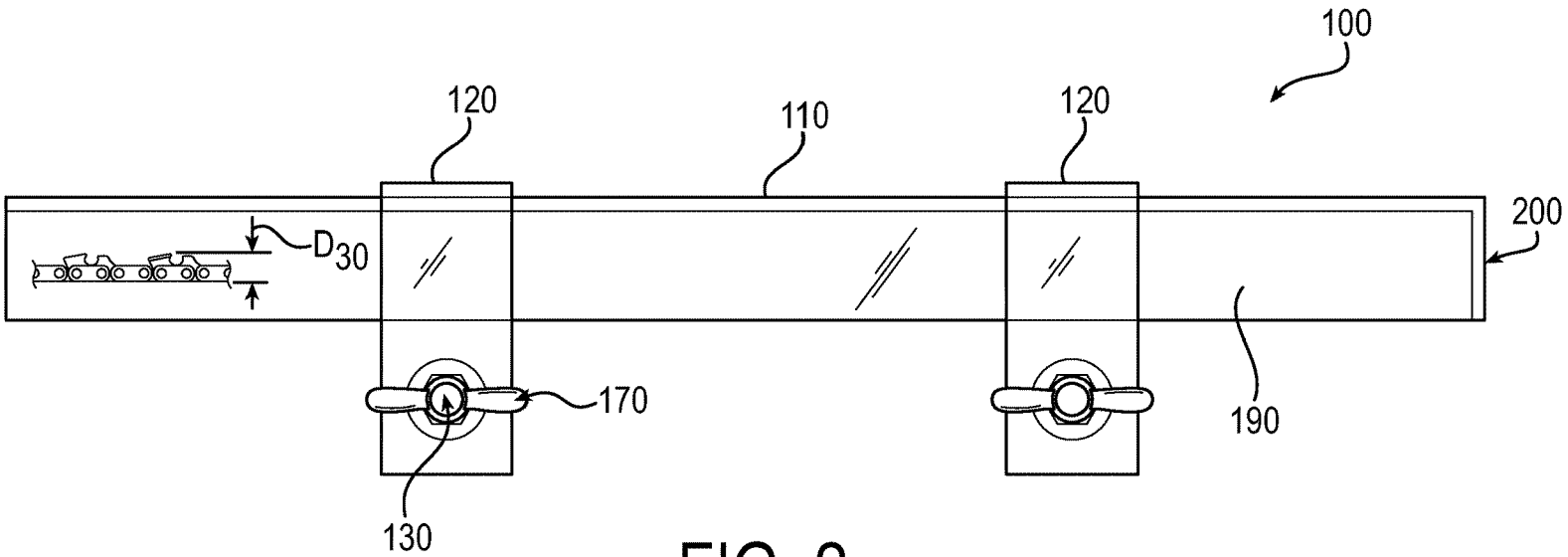
FIG. 2 is a side view of the chainsaw bar shield of FIG. 1, in accordance with an example.
Figure 3:
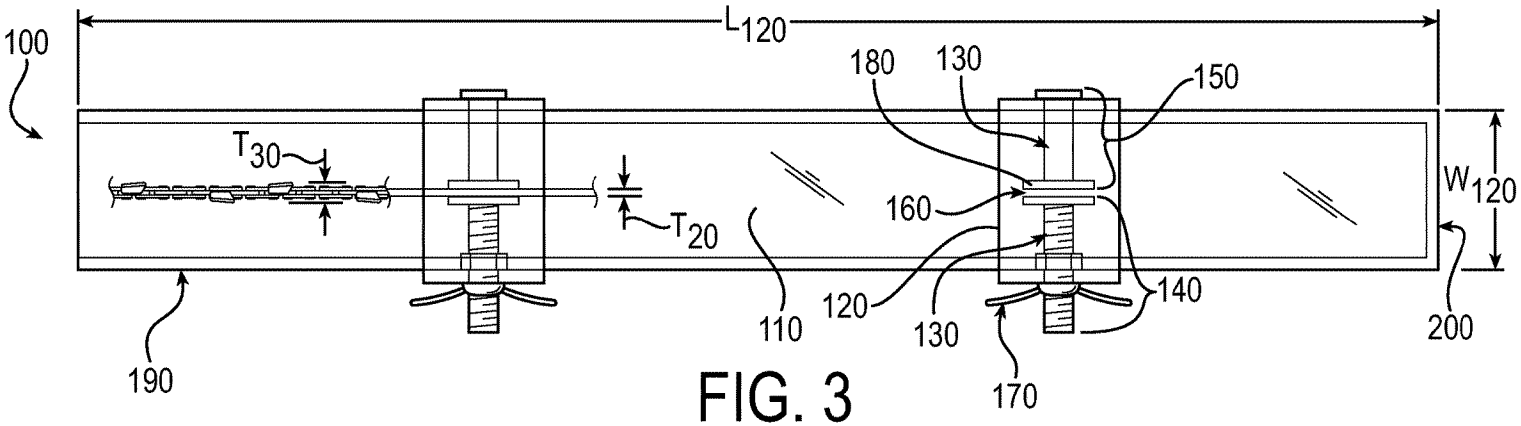
FIG. 3 is a top view of the chainsaw bar shield of FIG. 1, in accordance with an example.

In the example of FIG. 1, the first engaging structure 140 and the second engaging structure 150 engage a first side 60 of a chainsaw bar 20 and a second side 70 of a chainsaw bar 20, respectively. The bar shield arm 110 comprises an arm length $L_{120}$ longer than a chainsaw bar length $L_{20}$, the chainsaw bar length $L_{20}$ being perpendicular to the chainsaw bar width $W_{20}$. Additionally, the bar shield arm 110 comprises an arm width $W_{120}$ which is wider than the chainsaw bar thickness $T_{20}$ and/or the chain/cutting thickness $T_{30}$, the chainsaw bar thickness $T_{20}$ being perpendicular to the chainsaw bar length $L_{20}$ and the chainsaw bar width $W_{20}$ ($T_{20}$ and $T_{30}$ are illustrated in FIG. 3). The bar shield arm 110 of FIG. 1 further comprises a pair of arm lips 190. The arm lip 190 is perpendicular to and operatively connected to the bar shield arm about the chainsaw bar and/or the chainsaw chain. In the example of FIG. 1, the arm lip 190 conceals the chain depth $D_{30}$ (illustrated in FIG. 2). FIG. 2 further illustrates the chainsaw bar shield of FIG. 1 otherwise independent of the chainsaw 10.

Figure 4:
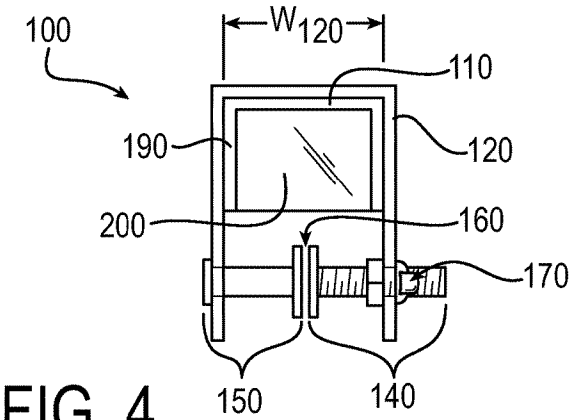
FIG. 4 is an end view of the chainsaw bar shield of FIG. 1, in accordance with an example.

FIG. 2 is a side view of the chainsaw bar shield 100 of FIG. 1. The chainsaw bar shield 100 comprises a bar shield arm 110, a securing mechanism 120, and a pinching structure 130. FIG. 3 and FIG. 4 are a top view and a cross-sectional end view, respectively, of the chainsaw bar shield of FIG. 1 and FIG. 2. Again, the chainsaw bar shield 100 comprises a bar shield arm 110, a securing mechanism 120, an advancing mechanism 170, and a pinching structure 130. Further illustrated by FIGS. 3-4 is the first engaging structure 140, the second engaging structure 150, and the pinch point 160. An advancing mechanism 170 moves the first engaging structure 140 and/or second engaging structure 150 to and from one another. The first engaging structure 140 and the second engaging structure 150 further comprise dampening material 180. FIG. 3 illustrates the arm length $L_{120}$ and FIG. 4 illustrates the arm width $W_{120}$. Arm lips 190 further extend from the arm 110. An end arm 200 is also operatively connected to the arm 110.

Figure 5:
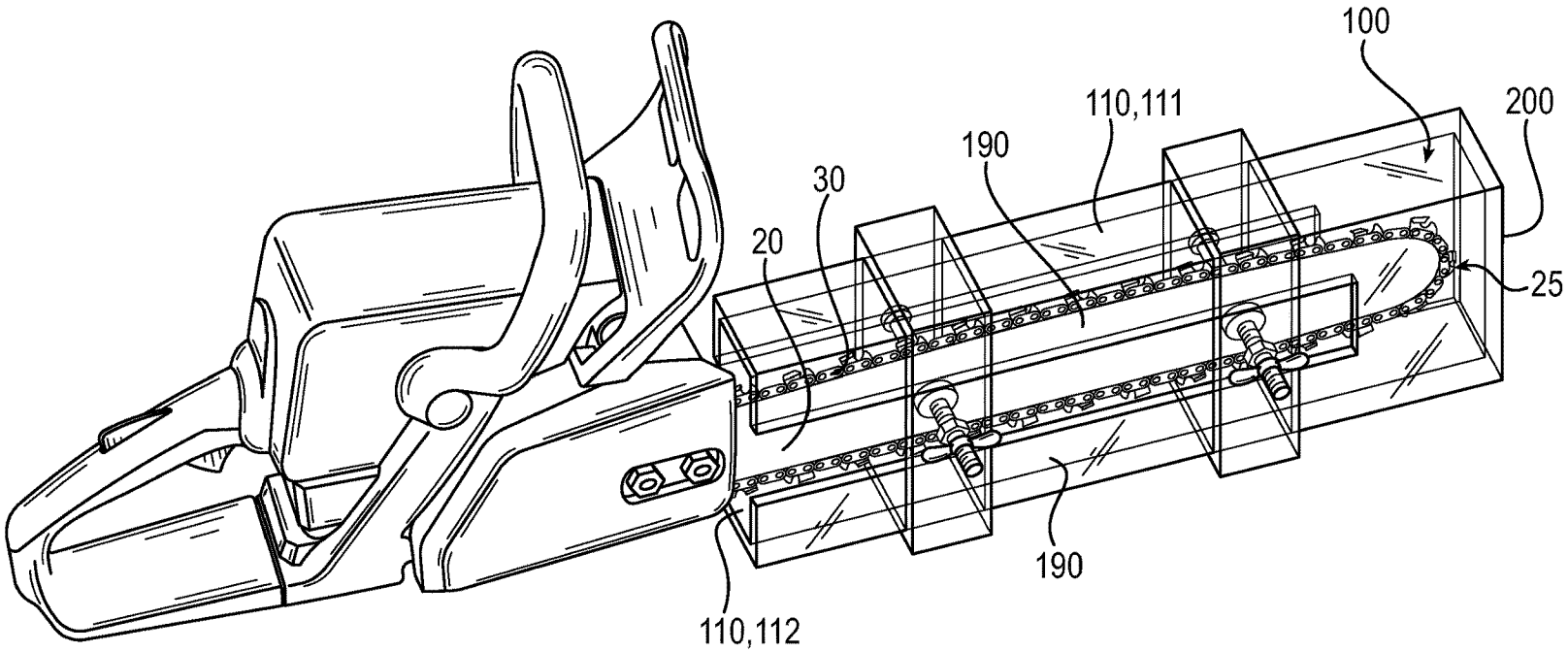
FIG. 5 is an isometric view of a chainsaw in a chainsaw bar shield, in accordance with an example.

Turning to the example of FIG. 5, a chainsaw bar shield 100 comprises multiple bar shield arms 110. In particular, a bar shield arm 110, that is a first bar shield arm 111, is constructed to be elevated above the chainsaw bar 20 and the chainsaw chain 30 and a second bar shield arm 112 positioned below the chainsaw bar 20 and the chainsaw chain 30. The chainsaw bar shield 100 also comprises an end arm 200 to an end of the first bar shield arm 111 and an end of the second bar shield arm 112. The end arm 200 is constructed to be positioned to the terminal end 25 of the chainsaw bar. In FIG. 5, the first bar shield arm 111, the second bar shield arm 112, and the end arm 200 each include arm lips 190.

Figure 6:
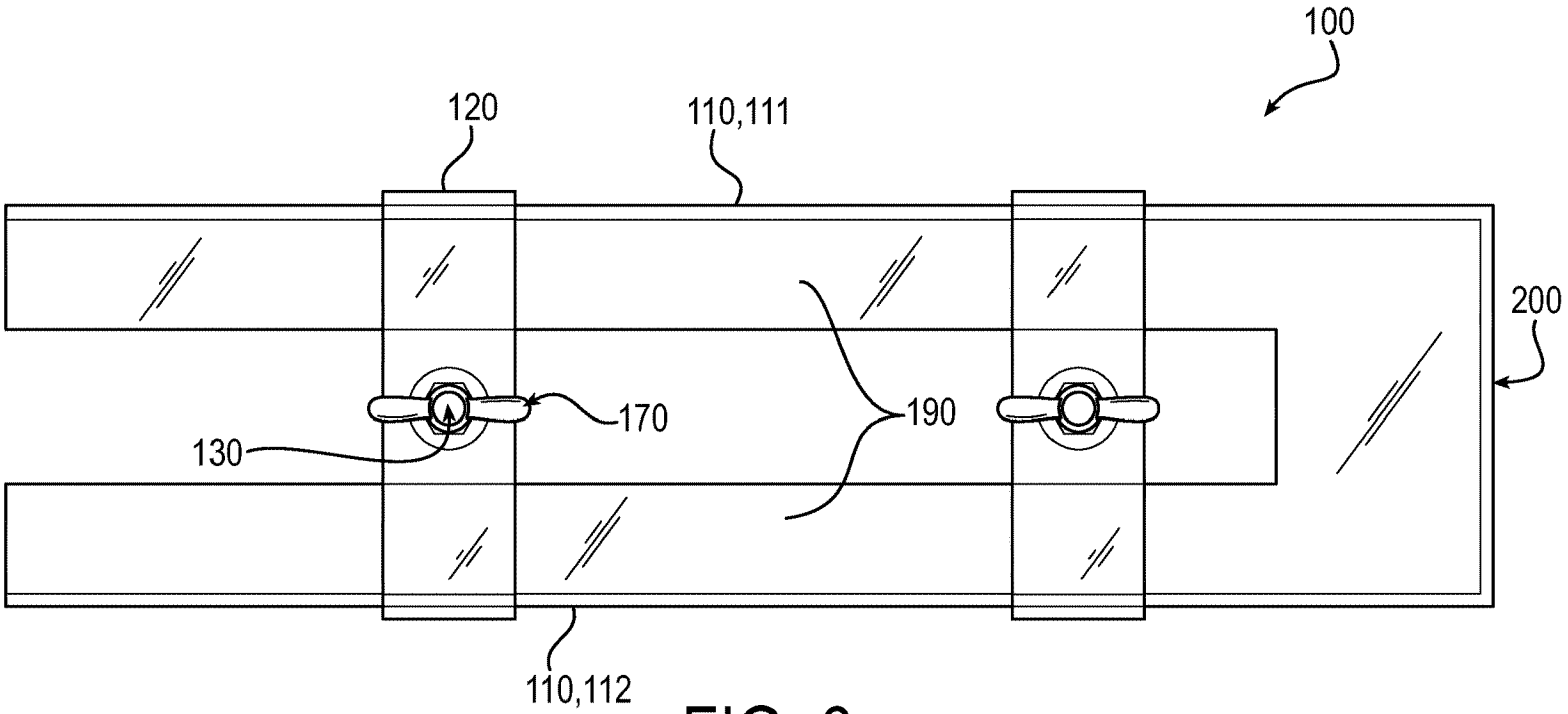
FIG. 6 is a side view of a chainsaw bar shield of FIG. 5, in accordance with an example.
Figure 7:
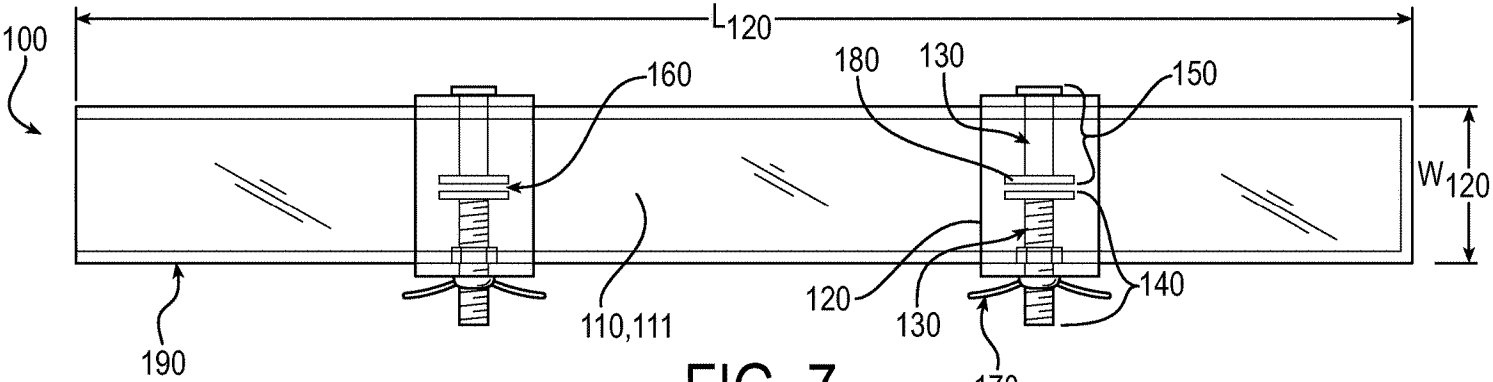
FIG. 7 is a top view of a chainsaw bar shield of FIG. 5, in accordance with an example.
Figure 8:
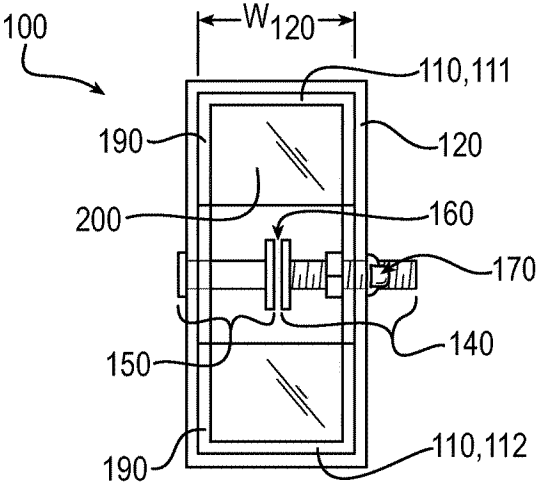
FIG. 8 is an end view of a chainsaw bar shield of FIG. 5, in accordance with an example.
Figure 9:
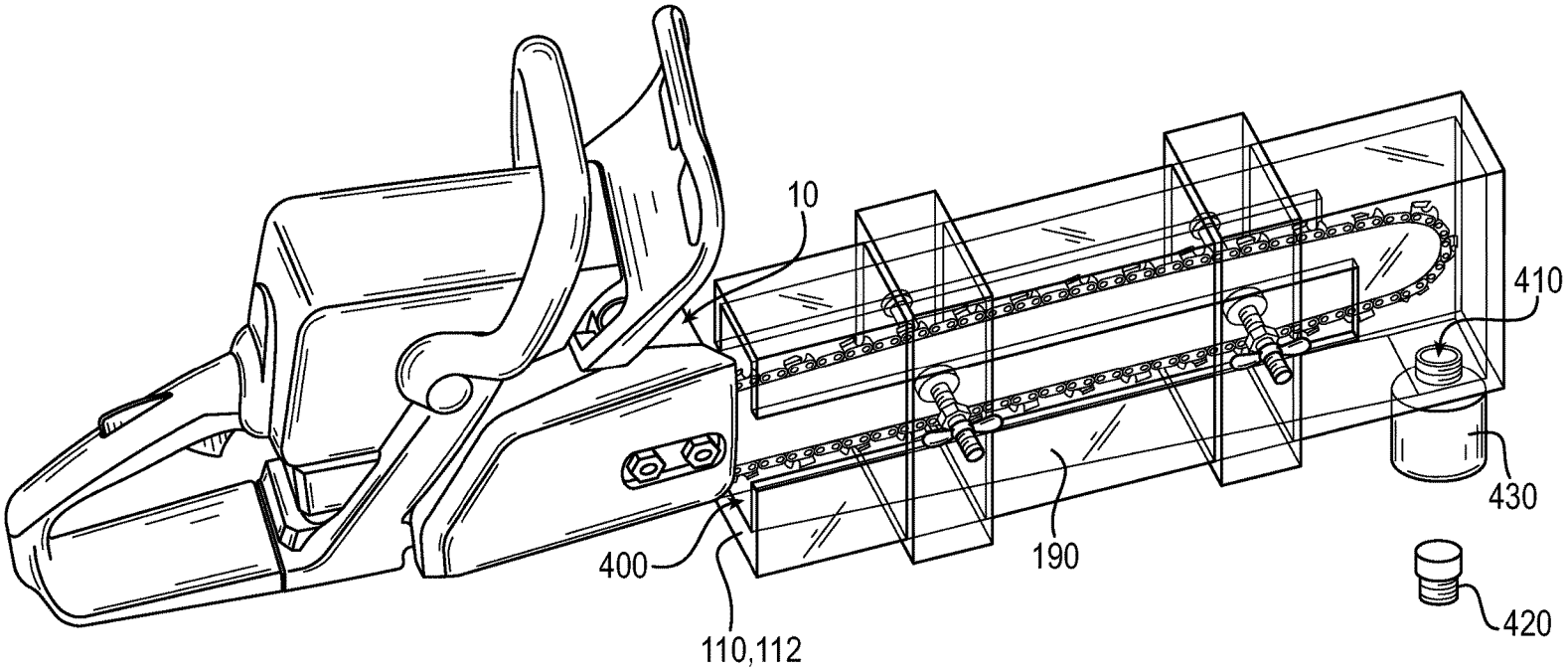
FIG. 9 is an isometric view of a chainsaw in a chainsaw bar shield, in accordance with an example.
Figure 10:
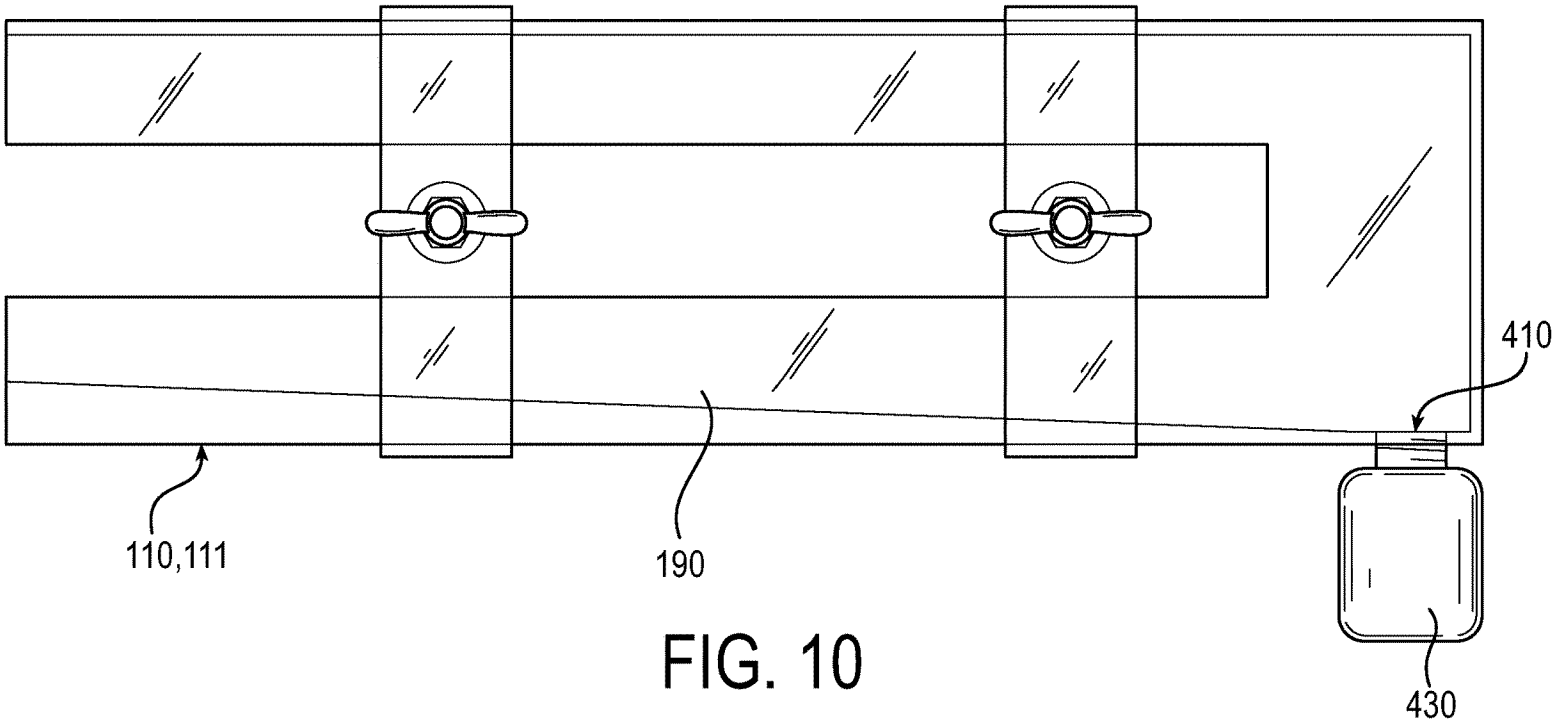
FIG. 10 is a side view of a chainsaw bar shield of FIG. 9, in accordance with an example.
Figure 11:
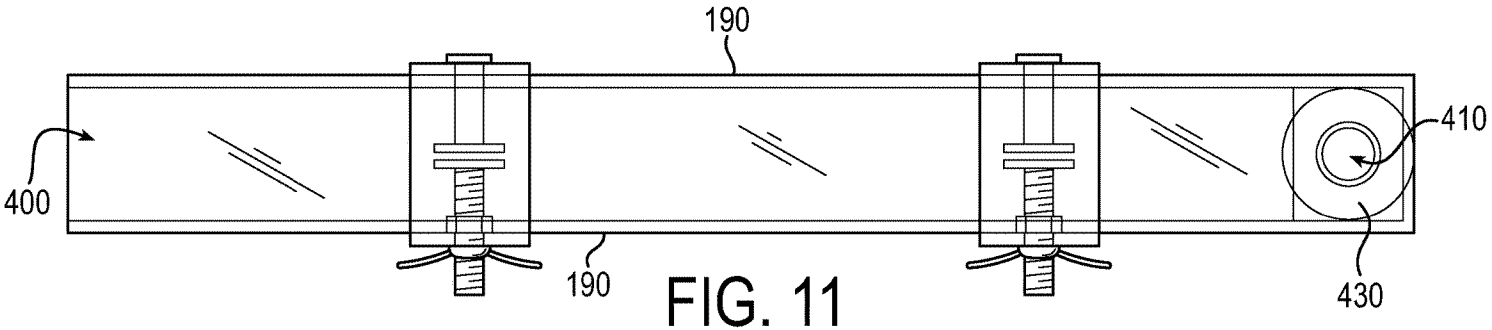
FIG. 11 is a top view of a chainsaw bar shield of FIG. 9, in accordance with an example.
Figure 12:
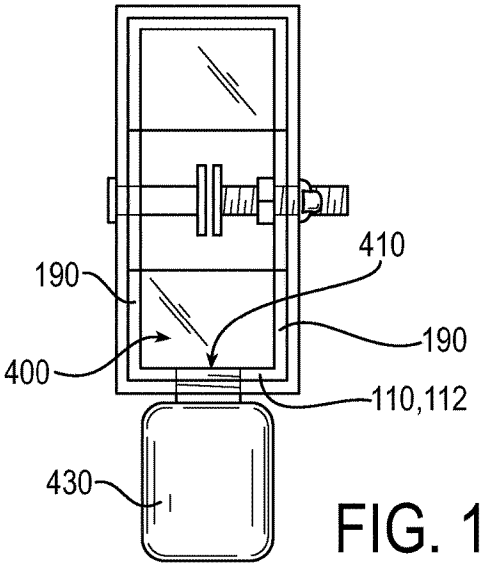
FIG. 12 is an end view of a chainsaw bar shield of FIG. 9, in accordance with an example.

FIG. 6 is a side view of the chainsaw bar shield 100 of FIG. 5. The chainsaw bar shield 100 comprises a bar shield arm 110, a securing mechanism 120, and a pinching structure 130. FIG. 7 and FIG. 8 are a top view and an end view, respectively, of the chainsaw bar shield of FIG. 5 and FIG. 6. Again, the chainsaw bar shield 100 comprises a bar shield arm 110 (including a first bar shield arm 111 and a second bar shield arm 112) a securing mechanism 120, an advancing mechanism 170, and a pinching structure 130. Further illustrated by FIGS. 7-8 is the first engaging structure 140, the second engaging structure 150, and the pinch point 160. An advancing mechanism 170 moves the first engaging structure 140 and/or second engaging structure 150 to and from one another. The first engaging structure 140 and the second engaging structure 150 further comprise dampening material 180. FIG. 7 illustrates the arm length $L_{120}$ and arm width $W_{120}$ and FIG. 4 illustrates the arm width $W_{120}$. Arm lips 190 further extend from the arm 110. An end arm 200 is also operatively connected to the arm 110.

FIGS. 9-12 are a variation of the example of FIGS. 5-8, respectively, where at least the bottom or second bar shield arm 110, 112 further comprises a channel 400 for capturing liquid from the chainsaw 10, such as chainsaw bar oil. The channel 400 is formed between the arm lips 190 at each arm and directs the liquid to a drain aperture 410. The channel 400 may be a drip tray and/or a funnel. In this example, the channel 400 slopes toward the drain aperture 410. A plug 420 may be provided to seal the drain aperture 410. Additionally, a reservoir 430 may also be provided to capture and maintain the liquid. In some examples, a bottom bar shield arm comprising a channel may be provided for the sole purpose of collecting liquid, only.

Figure 13:
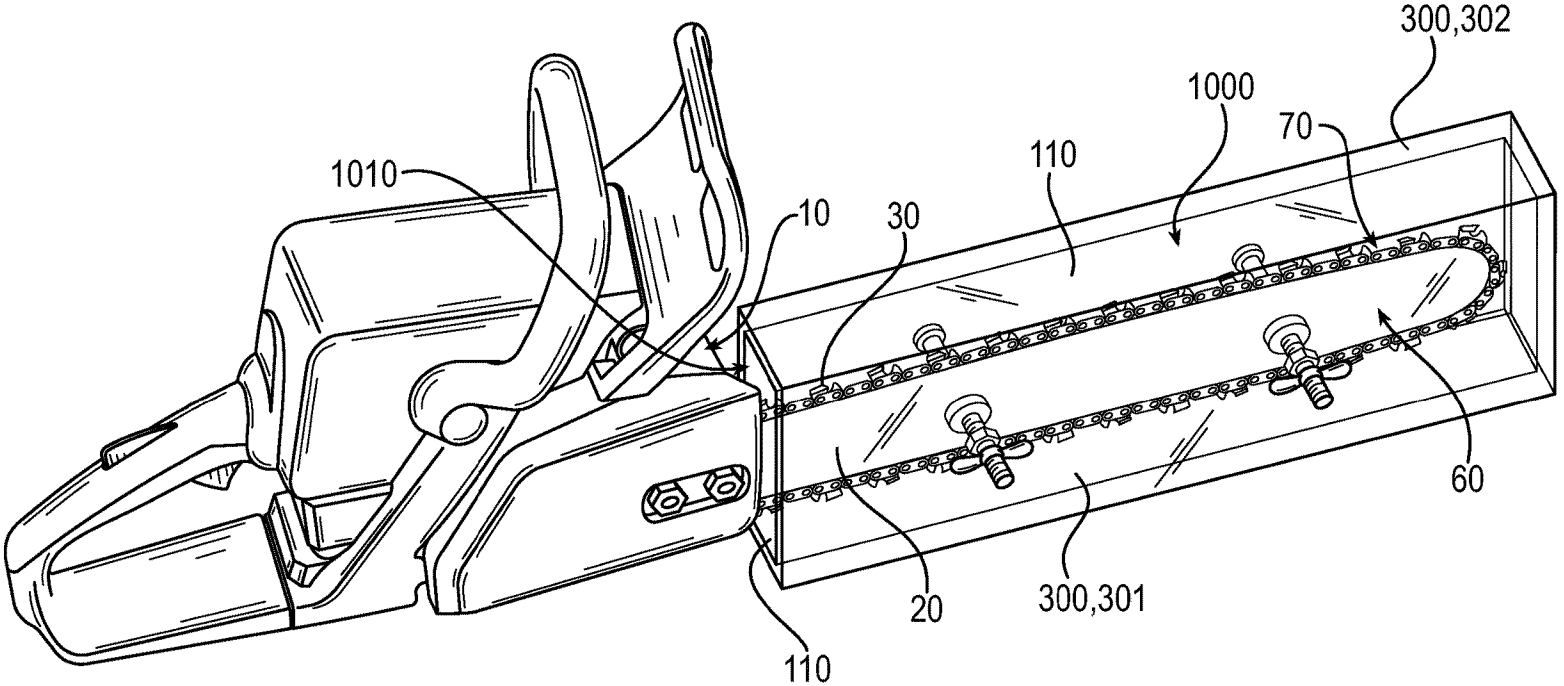
FIG. 13 is an isometric view of a chainsaw in a chainsaw bar shield, in accordance with an example.

In FIG. 13, a chainsaw bar shield is illustrated as a chainsaw enclosure 1000 around or about at least a portion of a chainsaw bar 20 and a chainsaw chain 30 of a chainsaw 10. The chainsaw enclosure 1000 comprises an enclosure opening 1010 for inserting the chainsaw bar and chainsaw chain. In the example, apart from the enclosure opening 1010, the chainsaw enclosure 1000 surrounds the chainsaw bar and chainsaw chain extending from the chainsaw housing. The chainsaw enclosure 1000 comprises multiple bar shield arms 110 including a lateral arm 300. Once a chainsaw bar 20 is inserted into the chainsaw enclosure 1000, a first lateral arm 301 is positioned to the first side 60 of the chainsaw bar and a second lateral arm 302 is positioned to the second side 70 of the chainsaw bar.

Figure 14:
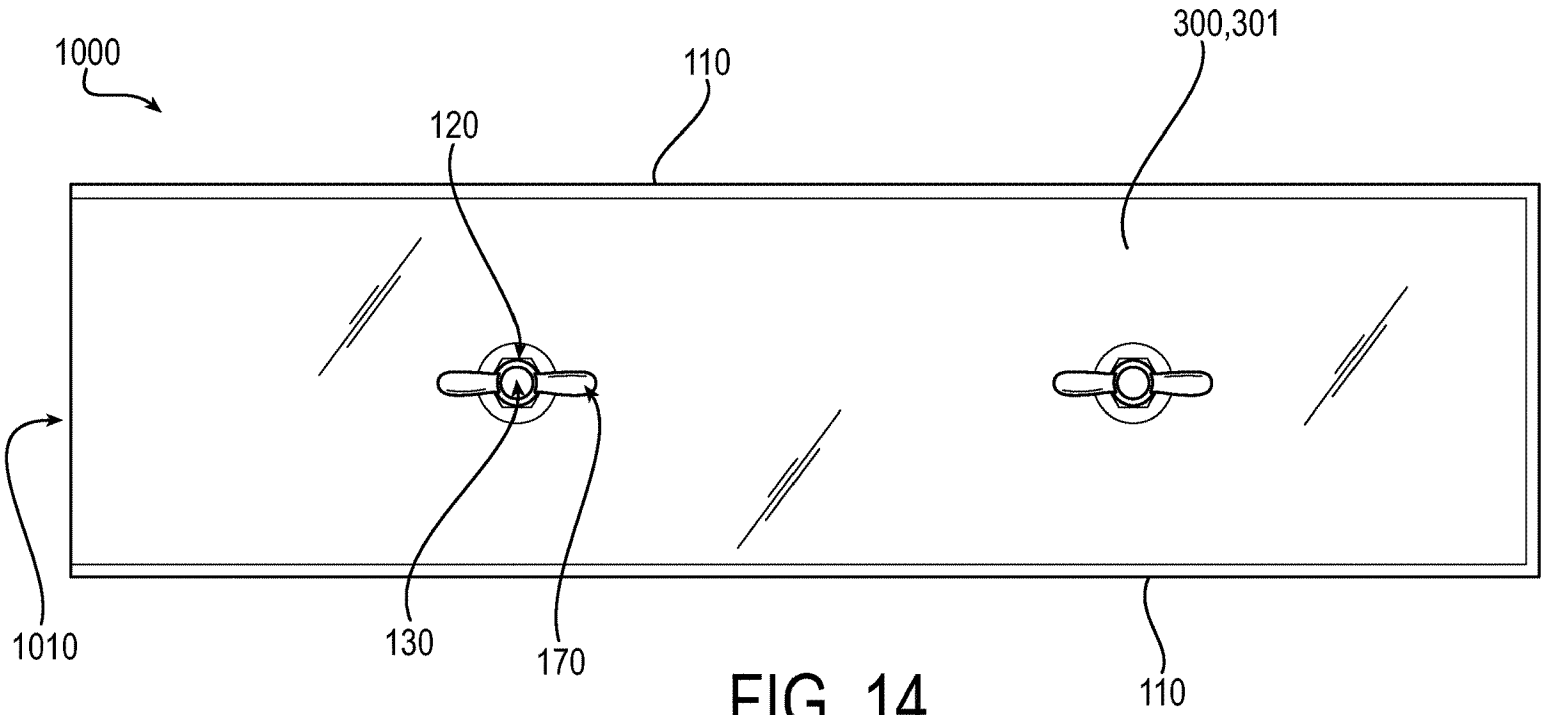
FIG. 14 is a side view of a chainsaw bar shield of FIG. 13, in accordance with an example.
Figure 15:
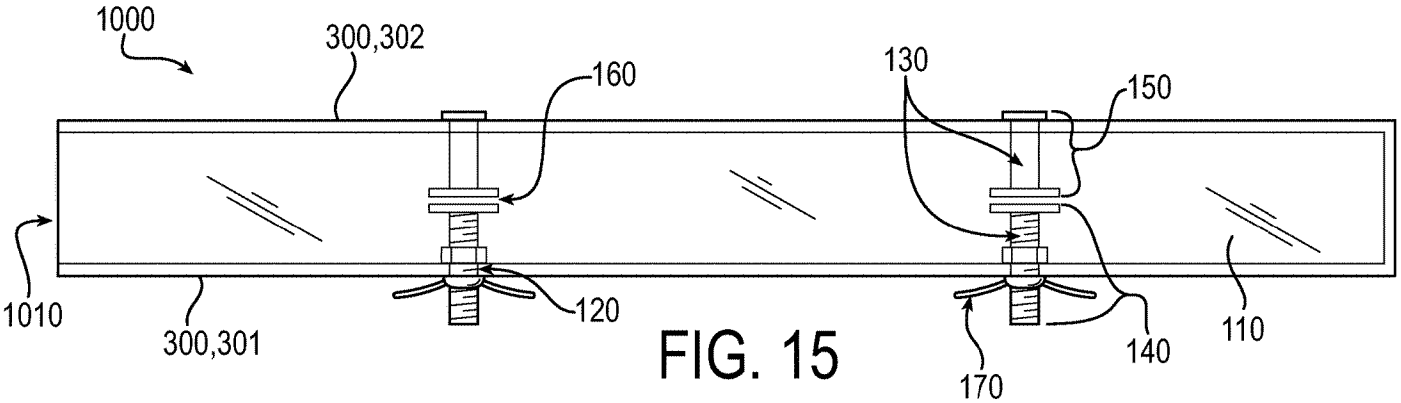
FIG. 15 is a top view of a chainsaw bar shield of FIG. 13, in accordance with an example.
Figure 16:
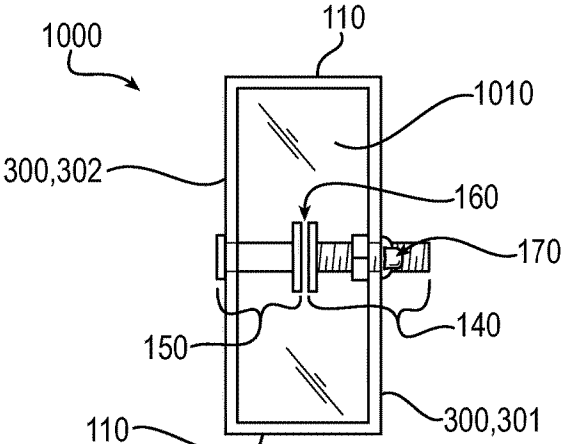
FIG. 16 is an end view of a chainsaw bar shield of FIG. 13, in accordance with an example.
Figure 17:
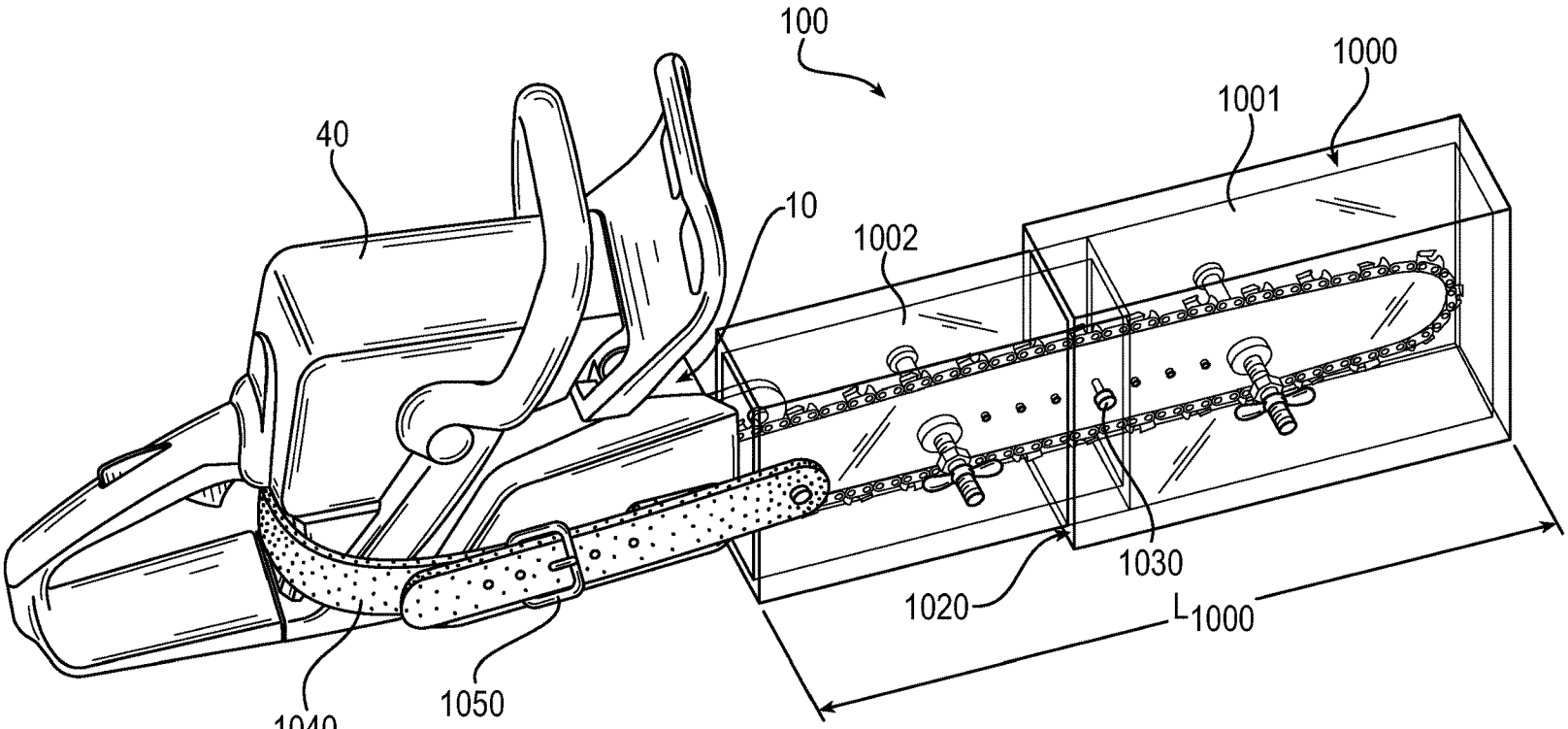
FIG. 17 is an isometric view of a chainsaw in a chainsaw bar shield, in accordance with an example.
Figure 18:
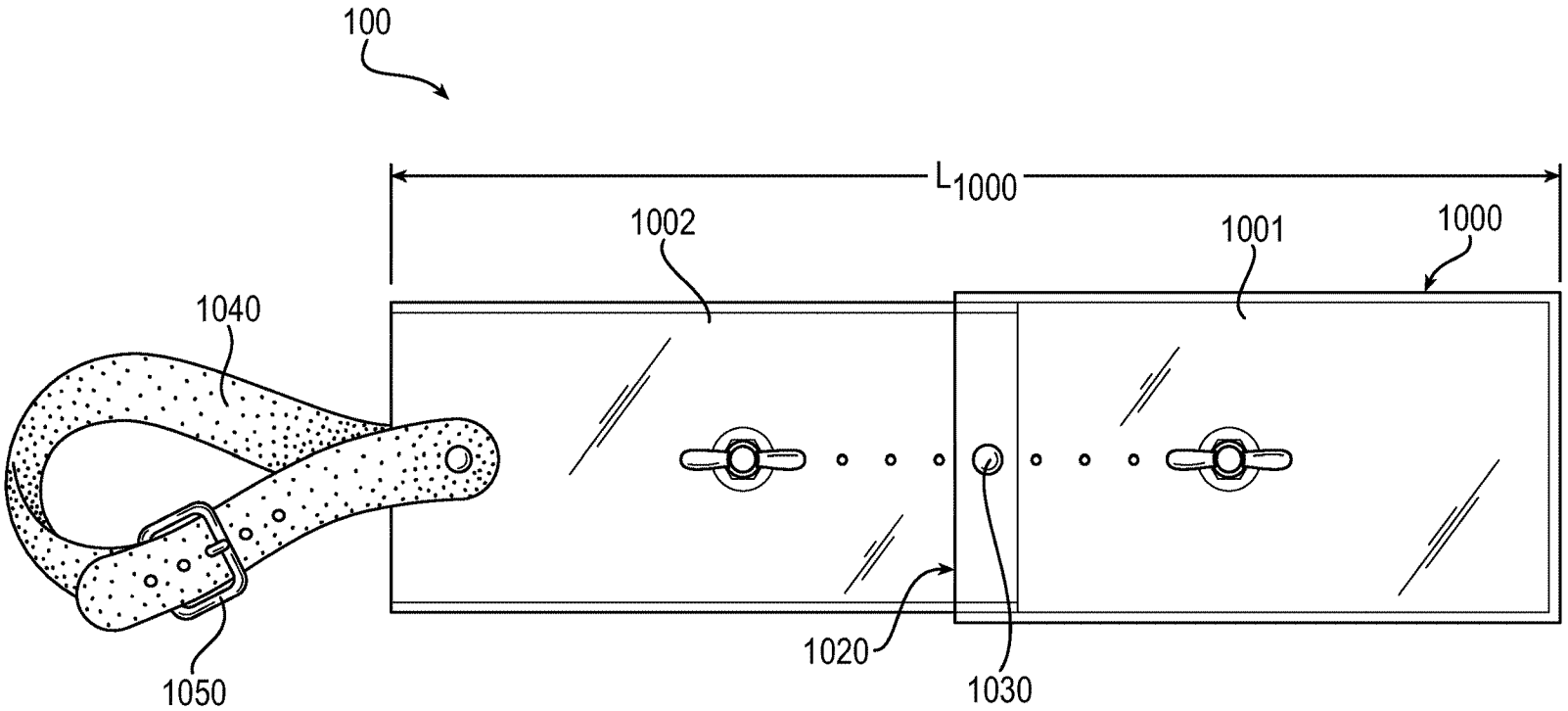
FIG. 18 is a side view of a chainsaw bar shield of FIG. 17, in accordance with an example.
Figure 19:
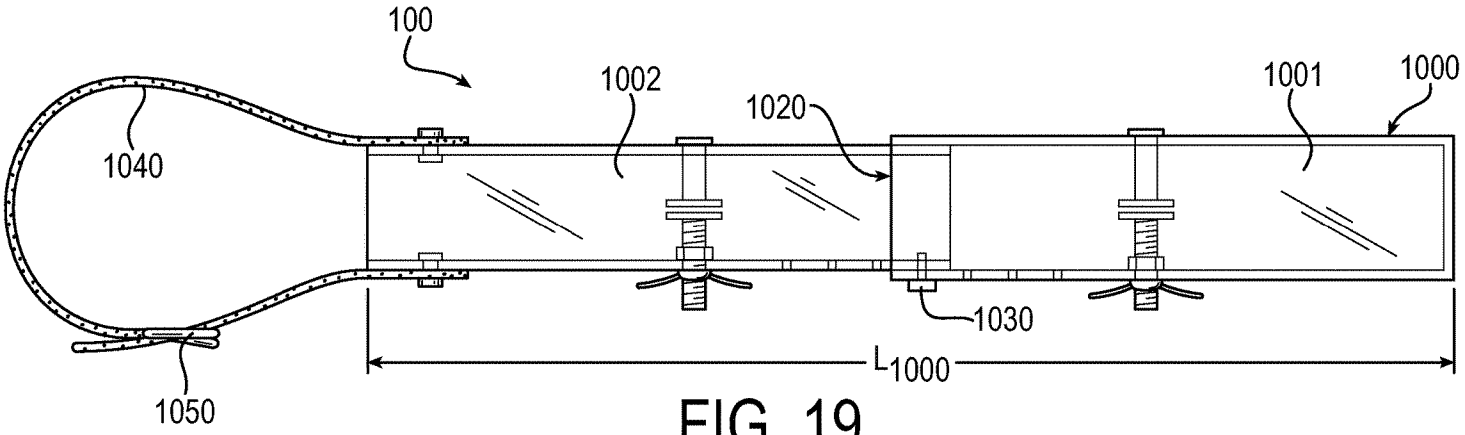
FIG. 19 is a top view of a chainsaw bar shield of FIG. 17, in accordance with an example.
Figure 20:
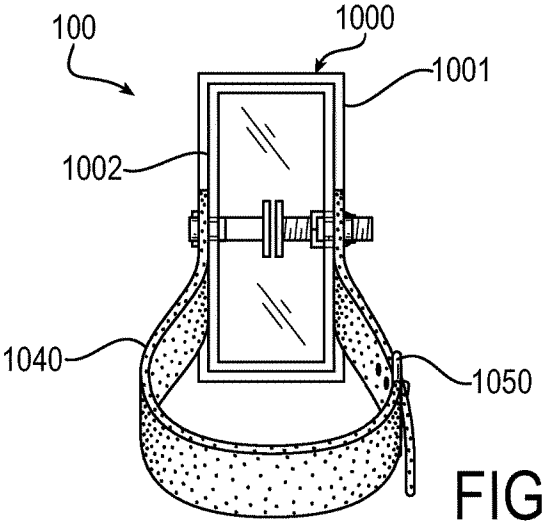
FIG. 20 is an end view of a chainsaw bar shield of FIG. 17, in accordance with an example.
Figure 21:
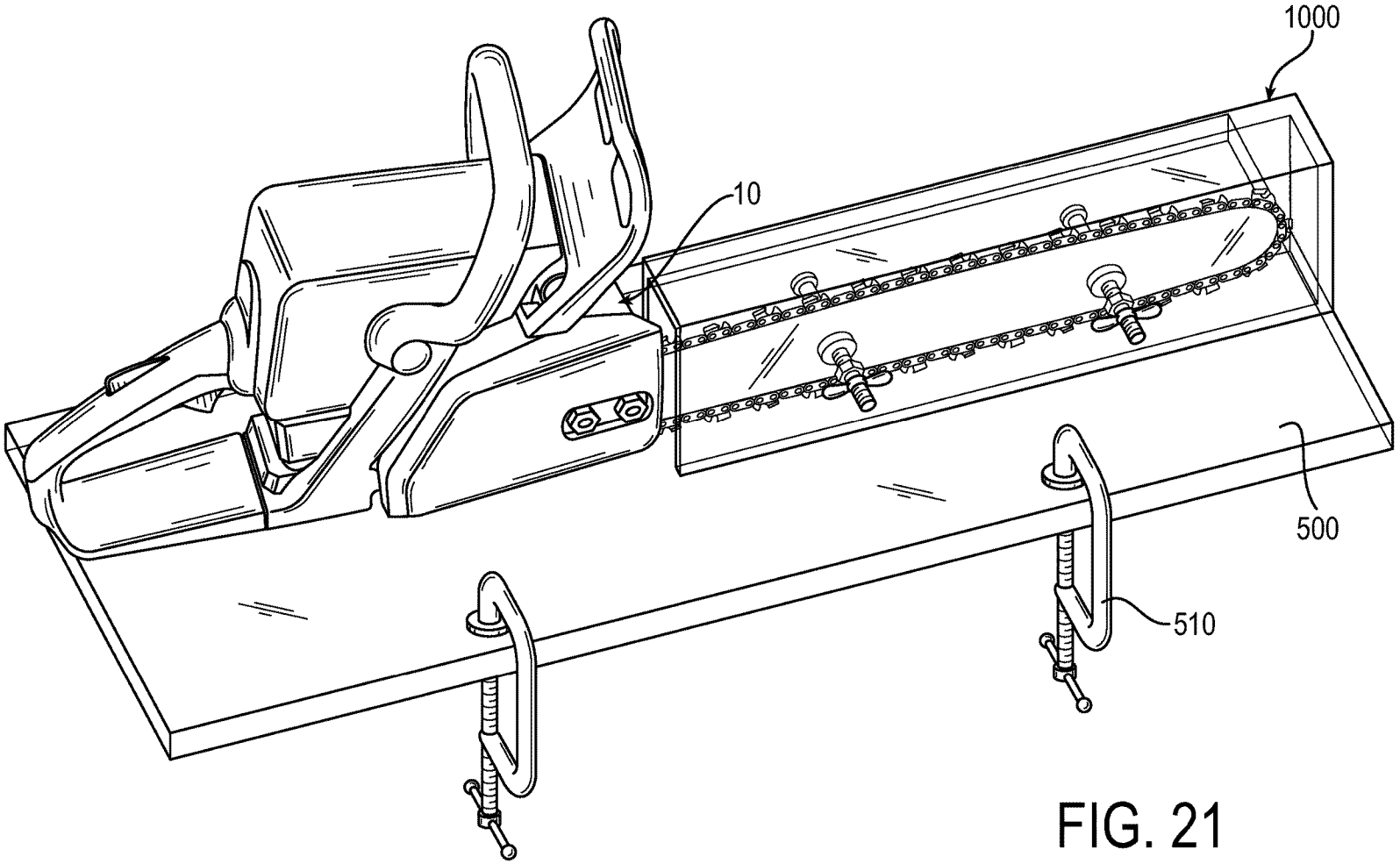
FIG. 21 is an isometric view of a chainsaw in a chainsaw bar shield, in accordance with an example.
Figure 22:
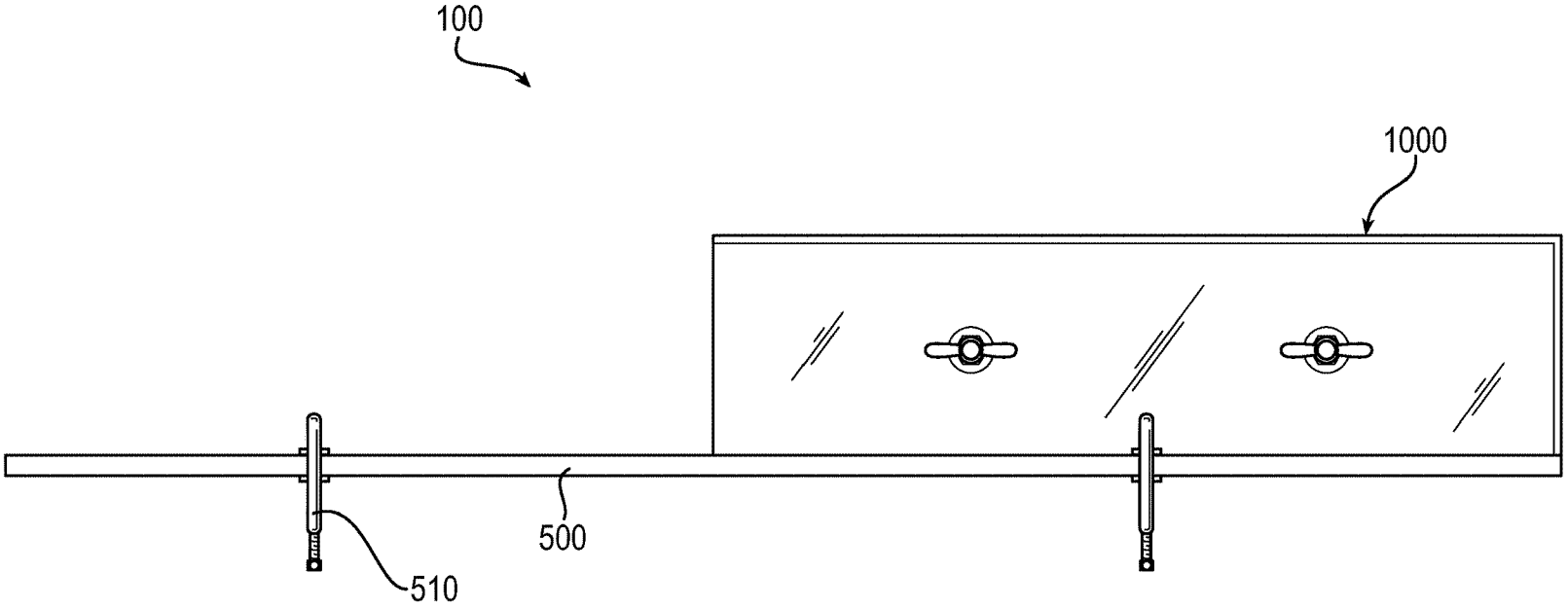
FIG. 22 is a side view of a chainsaw bar shield of FIG. 21, in accordance with an example.
Figure 23:
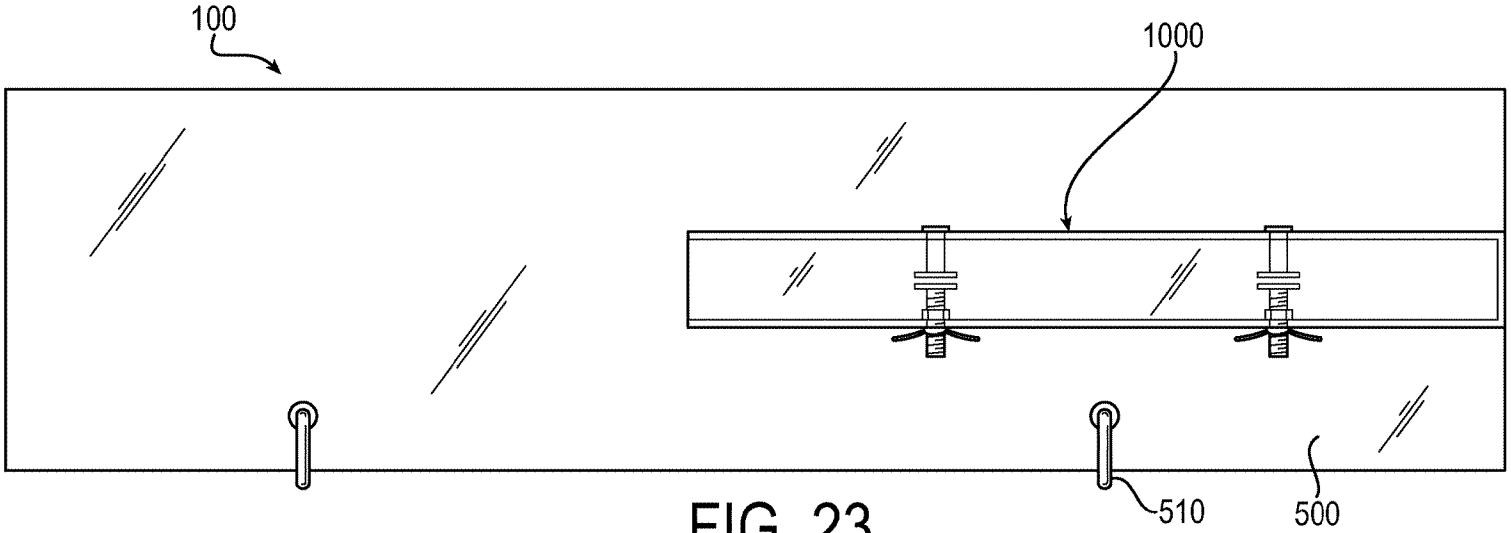
FIG. 23 is a top view of a chainsaw bar shield of FIG. 21, in accordance with an example.
Figure 24:
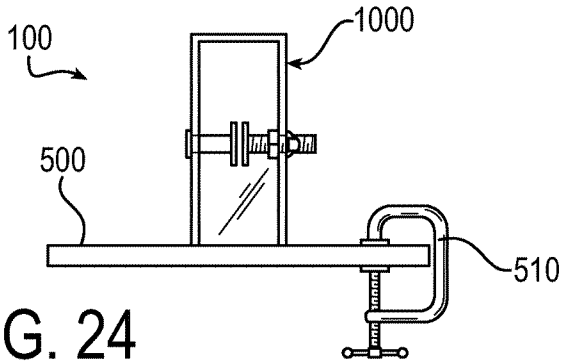
FIG. 24 is an end view of a chainsaw bar shield of FIG. 21, in accordance with an example.
Figure 25:
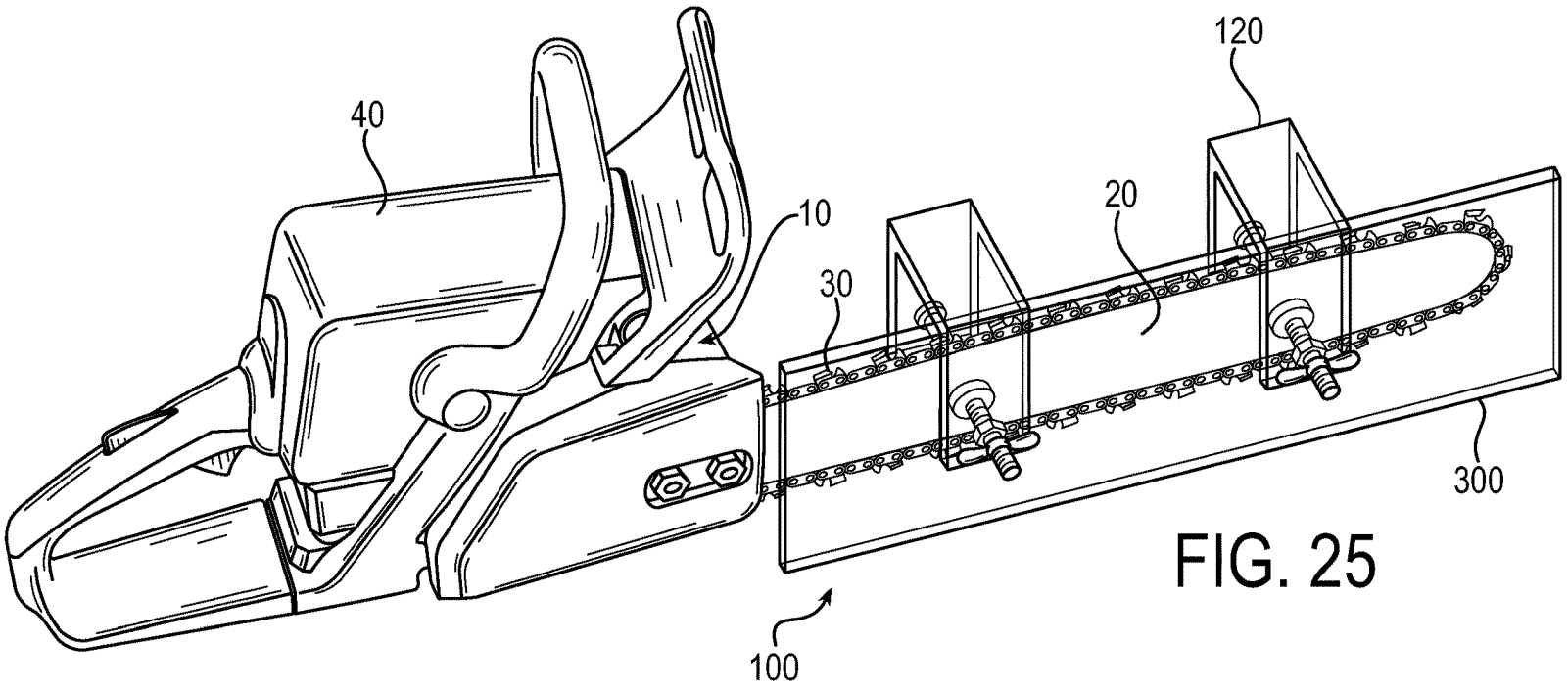
FIG. 25 is an isometric view of a chainsaw in a chainsaw bar shield, in accordance with an example.
Figure 26:
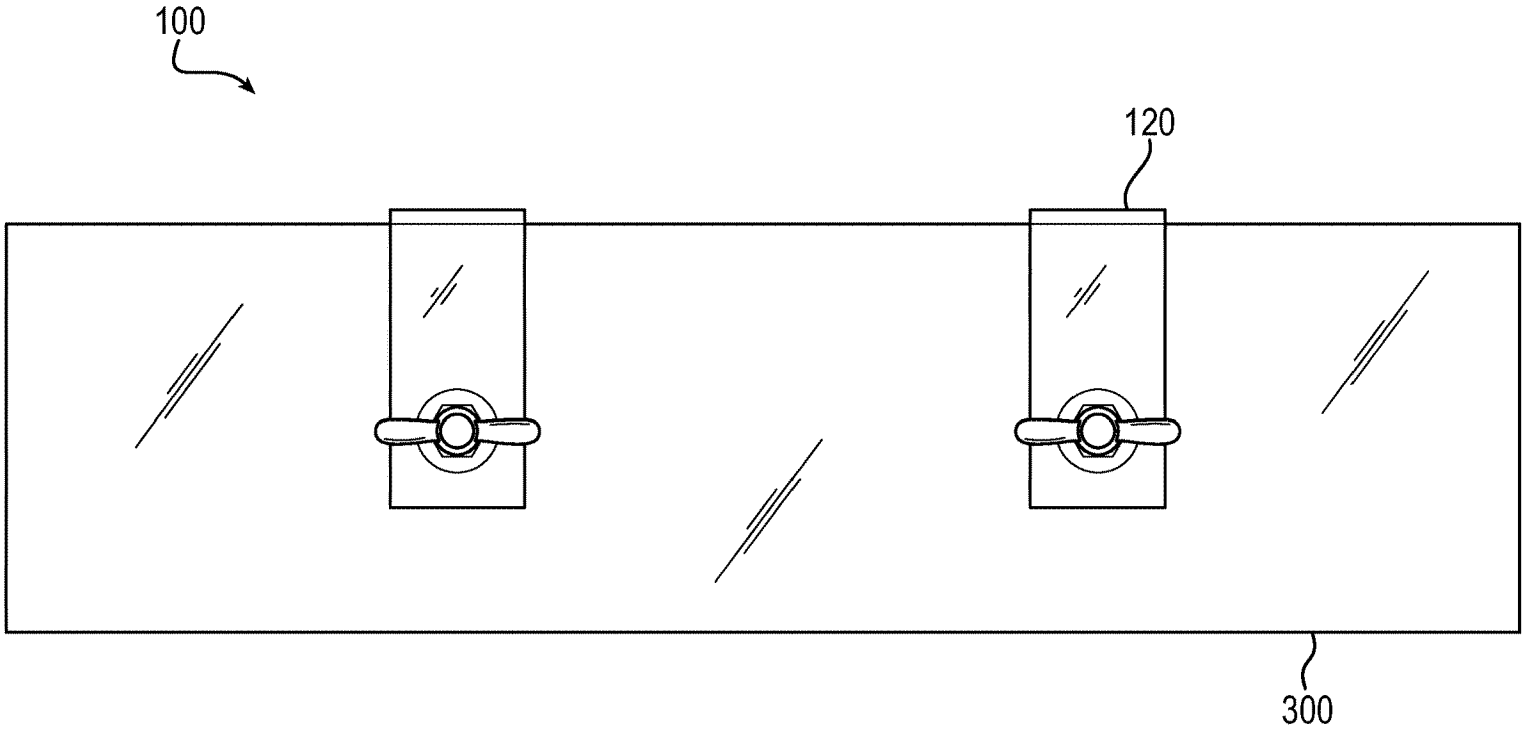
FIG. 26 is a side view of a chainsaw bar shield of FIG. 25, in accordance with an example.
Figure 27:
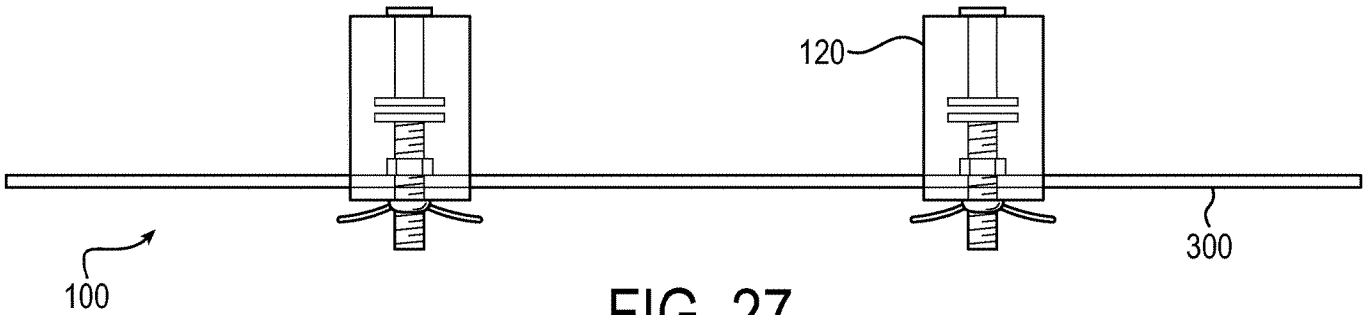
FIG. 27 is a top view of a chainsaw bar shield of FIG. 25, in accordance with an example.
Figure 28:
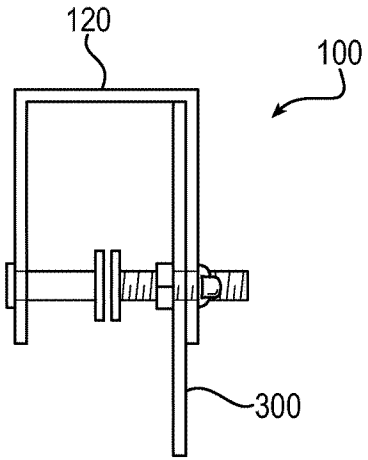
FIG. 28 is an end view of a chainsaw bar shield of FIG. 25, in accordance with an example.

FIG. 14, FIG. 15, and FIG. 16 are a side view, top view, and an end view, respectively, of the enclosure 1000 of FIG. 13 and features as previously described with respect to FIG. 13. Further illustrated is a securing mechanism 120, advancing mechanism 170, and a pinching structure 130, where a first engaging structure 140 and a second engaging structure 150 of the pinching structure 130 is attached to or extends through the lateral arms 300 of the enclosure 1000 and forms a pinch point 160 between. In particular, the advancing mechanism 170 moves the first engaging structure 140 relative the lateral arm 300.

FIGS. 17-20 are a variation of the example of FIGS. 13-16, respectively, where the enclosure 1000 further comprises an extension mechanism 1020. This example of an extension mechanism 1020 includes separate portions of an enclosure 1000 which overlap and slide relative one another. In this example, the extension mechanism 1020 is a sliding mechanism wherein a first enclosure 1001 extends about and relative a second enclosure 1002 such that it increases and/or decreases the length of the enclosure $L_{1000}$. This allows the enclosure 1000 to be adjusted for use with different sized chainsaws. A locking mechanism 1030 may be provided to secure the portions of the enclosure 1000 together. Further illustrated by FIGS. 17-20 is a housing clamp 1040 for further securing the chainsaw bar shield 100 to the chainsaw 10. In this example the housing clamp 1040 is a strap with a housing clamp connector 1050 or buckle which wraps around the chainsaw housing 40 to further secure the chainsaw 10 to the chainsaw bar shield 100 in a direction of the length of the chainsaw bar. Moreover, clamps may be provided to secure the chainsaw housing to the base.

FIGS. 21-24 is another variation of the example of FIGS. 13-16, respectively, where the enclosure 1000 of the chainsaw bar shield 100 further comprises a base 500. The base may be separate from the enclosure and attachable to the enclosure. In this example, the base 500 forms the bottom of the enclosure 1000 and further extends under the chainsaw housing 40 of the chainsaw 10 to support the chainsaw 10. Base fasteners 510 may also be provided to further secure the base 500 to a work surface.

In some examples, only one or more lateral arms may be provided. By example, FIGS. 25-28 illustrate a chainsaw bar shield 100 comprising a lateral arm 300 positioned to one side of the chainsaw bar 20. In this example, the length of the lateral arm 300 is greater than the length of the chainsaw bar 20 and chain 30 extending from the chainsaw housing 40. Further, the lateral arm 300 also spans at least the chainsaw bar width. A securing mechanism 120, as previously described, extends about the chainsaw bar 20 to secure the chainsaw bar shield 100 to the chainsaw bar 20.

Generally, methods of a using a chainsaw bar shield herein include providing a chainsaw bar shield secured to the bar of a chainsaw, but which does not engage or contact the chainsaw chain. As illustrated above, examples of a chainsaw bar shield include an arm positioned between the user and the chainsaw bar and/or chainsaw chain. As also illustrated above, other examples of a chainsaw bar shield include an enclosure which encases at least a portion of the chainsaw bar and chainsaw chain within the enclosure when the chainsaw bar and/or chainsaw chain is inserted into an opening of the enclosure. The chainsaw bar shield may surround one or more sides of the chainsaw bar and/or the chainsaw chain. In one example, the chainsaw bar shield may completely conceal the chainsaw bar and/or chainsaw chain or at least conceal the chainsaw bar and/or chainsaw chain extending from the chainsaw housing. In each example, the chainsaw arm and/or enclosure is offset from and does not engage or contact the chainsaw chain.

The examples as already illustrated above will now be discussed with additional variations and as methods of using a chainsaw bar shield. In one example as described with reference the example FIG. 1, the chainsaw bar shield comprises an arm. The arm is operatively connected at least one securing mechanism. The securing mechanism may comprise a pinching structure to secure the securing mechanism to a chainsaw bar. The pinching structure includes a first engaging structure for contacting and engaging a first side of a chainsaw bar. The pinching structure also includes a second engaging structure for contacting and engaging a second side of the chainsaw bar, opposite the first side of the chainsaw bar. A pinch point is defined between the first engaging structure and the second engaging structure at the chainsaw bar where force is applied to the chainsaw bar by the first and/or the second engaging structure in order to secure the chainsaw bar between the first and second engaging structure.

At least one of the first engaging structure and the second engaging structure may include an advancing mechanism which is adjustable in order to apply a force and/or advance the at least one of the first engaging structure and the second engaging structure to or from the chainsaw bar. In some examples, the first engaging structure and the second engaging structure both comprise an advancing mechanism. An example of an advancing mechanism includes a threaded rod which may advance through a threaded aperture in the securing mechanism for moving the threaded rod to and/or from the chainsaw bar and to and/or from the opposing engaging structure. This example and other examples include a bolt inserted through a threaded aperture, a nut and bolt combination, a ratchet system, a pulley system, or the like. Any combination of nuts and bolts, as contemplated by a person of ordinary skill in the art, may be used. Examples of nuts may include machined nuts, wing nuts, threaded knobs, or the like. Examples of bolts may include threaded rods, hex bolts, carriage bolts, lag bolts, screws, or the like. Other examples of an advancing mechanisms may include clamps, such as pressure clamps, toggle clamps, Destaco® clamps, spring clamps, C-clamps, or the like. Sleeves or other attachment means, such as clips, mechanical fasteners, straps, etc., may be additionally provided at the securing mechanism to accommodate clamps of different dimensions or of different types. Geared, pulley, pneumatic and/or hydraulic mechanism may additionally or alternatively be provided as an advancing mechanism. The various advancing mechanisms may be used in combination with one another in order to provide a varying degree of adjustment for engaging the chainsaw bar, and in particular, may provide for varying adjustment in order to be utilized with multiple chainsaw bars of varying sizes or thicknesses. To this end, a caliper may be used in combination with an advancing mechanism for fine adjustment.

A force is applied to the chainsaw bar by the advancing mechanism which pinches the chainsaw bar between the first engaging structure and the second engaging structure at the pinch point. A dampening material, such as rubber stoppers, fabrics, plastics, or the like, may be positioned between the engaging structures and the chainsaw bar to eliminate or reduce potential damage when applying force to the chainsaw bar. The engaging structure may be constructed from or comprise the dampening material. By pinching the chainsaw bar between the first engaging structure and the second engaging structure the securing mechanism is secured to the chainsaw bar by friction. Moreover, the dampening materials may comprise a friction surface for increasing the degree of friction between the engaging structures and the chainsaw bar. The chainsaw bar shield is secured to the chainsaw when the securing mechanism is secured to the chainsaw bar by way of friction. Additionally and alternatively, a suctioning structure, adhesive or magnet may be used to increase the friction, such as a suction cup, a cone-shaped structure, a vacuum, magnet or the like. The engaging structures do not contact or engage the chainsaw chain and/or chainsaw housing.

In one example, the arm is attached to the securing mechanism at a position which may be above or below the pinch point. The arm is thereby above or below the chainsaw bar and chain. In some examples, the arm has a length which is equal to or greater than the length of the portion of the chainsaw bar extending from the chainsaw housing. In another example, the arm may have a length which is equal to or greater than the length of the chainsaw bar, including the portion within the chainsaw housing. Such an arm would be provided to shield the user from the chainsaw bar in the instance the chainsaw housing is removed. The arm may also have a width which is equal to or greater than the thickness of the chainsaw bar and/or the cutting thickness of the chainsaw chain. Therefore, the arm completely shields a user from above or below the chainsaw bar and chain when positioned above or below the chainsaw bar and chain, respectively. Multiple securing mechanisms may be used in combination with the arm in order to adequately secure the arm along the length of the chainsaw bar. Additionally and alternatively, a single securing mechanism may comprise multiple pinching structures and, also, multiple opposing engaging structures. Further, a pinching structure may additionally or alternatively comprise multiple opposing engaging structures, thereby, creating multiple pinch points. A single advancing mechanism may be used for multiple engaging structures or, alternatively, an advancing structure may be provided at each.

The arm as described above may comprise one or more lips that may extend around or about the first side and/or the second side of the chainsaw bar. By extending the one or more lips around or about the chainsaw bar the chainsaw chain is at least partially surrounded by the chainsaw bar shield. This shields a user from all, or portions of, the chainsaw bar and chain. The arm and the one or more lips do not contact or engage the chain but are separated from the chainsaw chain and are supported by securing mechanism secured to the chainsaw bar. In one example, the one or more lips of the arm may wrap around the chainsaw chain in a manner which conceals the chainsaw chain, at least the depth of the chainsaw chain, but exposes a majority of the chainsaw bar or even the entire chainsaw bar. The lips may extend the full length, further than, or only a partial length of the chainsaw bar extending from the chainsaw housing. Further, the arm may include an end arm at the terminal end of the chainsaw bar, opposite the chainsaw housing. The end arm may extend from the end of the arm positioned opposite the chainsaw housing. The end arm conceals at least a portion of the terminal end of the chainsaw bar, opposite the chainsaw housing, and the chain located at the end of the chainsaw bar. The end arm may also connect a pair of arms, such as connecting an arm positioned above a pinch point to an arm positioned below a pinch point, thereby at least partially wrapping the chainsaw bar shield about the chainsaw bar on at least three sides, such as the top, the terminal end, and the bottom. The end arm may additionally have one or more lips which wrap around the chainsaw bar at the terminal end of the chainsaw bar to conceal the chainsaw chain without contacting or engaging the chainsaw chain. The end arm may comprise a curved profile consistent with the profile of the terminal end of the chainsaw bar and chain.

The arm may alternatively be a lateral arm offset from one side and/or another of the chainsaw bar by the securing mechanism. An example of a lateral arm, alone, is illustrated in FIGS. 25-28. It, however, is contemplated a lateral arm may be combined with other arms as also described herein. Again, the lateral arm is separate from the chain of the chainsaw and is supported by the securing mechanism. In one example of a lateral arm, the lateral arm has a width greater than the width of the chainsaw bar. In other words, the lateral arm extends above and/or below the top and/or bottom of the chainsaw bar and chain. By example, when working above the chainsaw bar and chain, the lateral arm may extend above the top of the chainsaw bar and chain so that a user's body part or an object would contact the lateral arm before contacting the chainsaw bar or chain. In another example, a lateral arm may have a width less than the width of the chainsaw bar but be positioned to extend above or below chainsaw bar and chain, depending on use. A lateral arm may also include one or more lips, as described with respect to the arm, which wrap around the chainsaw bar and chain without engaging or contacting the chain. In one example, the one or more lips may wrap around the chainsaw chain in a manner which conceals the chainsaw chain and/or at least the cutting width of the chainsaw chain. Further, a lateral arm may be provided to either side or both sides of the chainsaw bar. In one example, a first lateral arm may be provided to a first side of the chainsaw bar and extend above the chainsaw bar.

The arm, including the end arm and the lateral arm may be adjustable at the securing mechanism. By being adjustable at the securing mechanism or having adjustment between the securing mechanism and the arm, the position of the arm may be adjusted relative the chainsaw bar for fit and purpose, including proximity to the chainsaw bar and chain, the position along the chainsaw bar and chain, the position above and/or below the chainsaw bar and chain, etc. Adjustment may be accomplished by any adjustment mechanism known in the art including dials, ratchets, gears, pulleys, or the like. Additionally and alternatively, the proximity of each respective arm, with respect to the chainsaw bar and chain, may be adjusted by the position of the pinch point of the engaging structures secured to the chainsaw bar.

In one example, the arm may comprise a channel formed therein. The channel may be formed between the one or more lips, as previously described. An arm having a channel may be positioned above, below, and/or to the end of the chainsaw bar and chain. The channel captures the chain oil which may drip from a stationary chain or sprayed from a moving chain. The arm or channel may be oriented with an elevational drop to a centrally located aperture forming a drain aperture. In one example, the arm or channel may form a funnel extending to the drain aperture. In another example, the channel may be a drip tray. A plug may be used to seal the drain. A reservoir may be provided as an alternative to or in combination with the drain aperture to capture the oil. The reservoir may be separate from, formed in, extend from, or be connected to the arm and/or the channel.

A combination of arms may be provided to form an enclosure about the chainsaw bar and chain. In one example, the enclosure may conceal the chainsaw bar and chain which extends from the chainsaw housing. The various arms, including lateral arms and end arms, may be connected to one another or formed together to form the enclosure. The enclosure may be formed of a single material for encasing the chainsaw bar and chain. An enclosure opening may be provided to one end of the enclosure for inserting the chainsaw bar and chain. In one example, the chainsaw bar and chain is inserted into the enclosure opening until the enclosure is adjacent to or contacts the chainsaw housing. In one example, the chainsaw bar and chain is entirely enclosed within the enclosure in combination with the chainsaw housing. In another example, the chainsaw bar and chain is substantially enclosed within the enclosure in combination with the chainsaw housing, wherein substantially is 90% or more. As previously stated with respect to the arm, the enclosure is separate from and does not contact or engage the chainsaw chain.

The enclosure may further comprise the securing mechanism. In other words, the advancing mechanism may extend from and through a side or an arm, such as a lateral arm, of the enclosure. By example, the enclosure may include a threaded aperture through which the advancing mechanism extends to the engaging structure for engaging the chainsaw bar. Likewise, an engaging structure may be connected to or extend from the enclosure.

The arm, including end arm and lateral arm, and/or the enclosure may be adjusted to chainsaw's of different sizes. In one example, the arm, including a lateral arm, and the enclosure may be retractable or extendable its length at an extension mechanism. In order to be retractable or extendable, the arm and the enclosure may comprise an overlapping configuration, where one portion of an arm or one portion of an enclosure extends and slides overtop an adjacent portion of the arm or the enclosure. A sliding mechanism may be provided where the first arm overlaps a second arm. Likewise, a sliding mechanism maybe be provided where the first enclosure overlaps a second enclosure. The sliding mechanism controls the distance of travel and maintains contact between the first arm with the second arm and the first enclosure with the second enclosure, respectively. An accordion structure may additionally or alternatively be provided. The accordion structure may separate a first arm from a second arm and the first enclosure from the second enclosure, respectively, while allowing the first to move relative the second. Once a desire length has been reached, a locking mechanism may be provided to secure the first arm to the second arm and the first enclosure to the second enclosure, respectively. The locking mechanism may be by any mechanical means known in the art. Examples of locking mechanisms may be a pin, tape, Velcro, screw, or the like.

In some examples, portions of the chainsaw bar shield may be additionally moveable relative other portions of the bar shield. By example, the lip(s) may be moveable relative the arm, the end arm may be moveable relative another arm, and the lateral arm may be moveable relative to another arm. Moreover, the arms or the enclosure may be moveable relative a base, as further described below. Similarly, the securing mechanism may be moveable, positionable, and/or removeable relative an arm or the enclosure. Further, in some examples, portions of the enclosure may be moveable relative other portions of the enclosure. By example, a lateral side of an enclosure may be moveable relative the top of the enclosure. As used herein, moveable may include removable fastening mechanisms, pivoting fastening mechanisms, adjustable fastening mechanism, sliding fastening mechanisms, or the like. By example, a hinge may be used to secure a lip to an arm allowing the lip to be rotated to provide additional access to the chainsaw bar and/or chainsaw chain. Similarly, a lateral side of the enclosure may be secured to a top or bottom of the enclosure by a hinge to provide additional access to the chainsaw bar and/or chain. A combination of fastening mechanisms may be used. By example, when a hinge is provided a securing mechanism may secure a lateral side opposite the hinge. Yet, in some examples, each of the parts may be rigidly secured to one another and/or molded together.

In examples of the chainsaw bar shield, the chainsaw bar shield may be constructed of various materials. Any type of construction material is contemplated herein. In some examples, the arm and/or enclosure is constructed of molded plastics, plexi-glass, metals, a combination thereof, or the like. In the examples of a chainsaw bar shield, characteristics or descriptors of the construction materials that may be utilized may include resilient, durable, puncture resistant, impermeable to liquids, non-porous, thin, lightweight, or the like. In one example, a material used to construct the chainsaw bar shield may be transparent. In another example, a material used to construct the chainsaw bar shield may be opaque or even painted, including a safety color, such as red, orange, yellow, or the like, and/or a safety configuration, such as striped, labeled, or the like. A transparent material would provide the user the ability to position the chainsaw bar shield, including the engaging structures, in the proper position on the chainsaw bar. When visibility is unavailable for positioning, the chainsaw bar shield may further comprise one or more notches extending its length and/or height to designate the position of or for centering the engaging structures, the pinch points, and/or the chainsaw bar. In some examples, the chainsaw bar shield and, in one particular example, the notches may further comprise a measuring device or measurement insignia. A combination of materials may be used, for example, a transparent material may be used (i.e. a viewing window) in combination with an opaque and/or painted material in order to capitalize on the various qualities of the different materials at different locations of the chainsaw bar shield. As indicated above, the chainsaw bar shield may be constructed of materials which may be impermeable to liquids and/or non-porous. Additionally or alternatively, the many components and the connections between the many components of the chainsaw bar shield may sealed to be impermeable to liquids and/or non-porous in order to capture the bar oil or other liquids.

In one example, the chainsaw bar shield may further comprise a housing clamp. In order to further secure the chainsaw bar shield to a chainsaw, the housing clamp may extend from the one or more arms, the securing mechanism, and/or the enclosure. One example of a housing clamp is a strap which may be tightened about a chainsaw housing to secure the chainsaw bar shield to the chainsaw in at least the lateral direction, or in a direction of the length of the chainsaw bar shield. In one example, the strap may be connected directly to the chainsaw housing by a fastener, such as a snap. In another example, the strap may wrap around the chainsaw housing and/or through the chainsaw handle and/or chain brake. The strap may include a connector which allows it to extend through the handle, Examples of a connector may be Velcro, buckle, ratchet mechanism, or the like. The housing clamp provides additional security to maintain the chainsaw bar shield in the proper position and to counteract any vibrations during operation of the chainsaw.

The chainsaw bar shield may further comprise a base. The base may be attached to the arm, enclosure, and or securing mechanism. Once a chainsaw is secured to a securing mechanism, a base may further secure the chainsaw and the chainsaw bar shield to a work surface. A base clamp may be attached to the base for securing the base to the work surface. A work surface may be a conventional work surface and/or a makeshift work surface, such as a truck tailgate, log, sheet of plywood, sawhorses, or the like. In one example, the base may additionally extend below and support the chainsaw housing. Further, the chainsaw housing may also be secured to the base by a fastener, such as a clamp, strap, or the like. The base provides additional support for maintaining the chainsaw using the chainsaw bar shield and increasing hands-free flexibility and access to the chainsaw for the maintenance activities. Other examples for increased flexibility include a chainsaw bar shield which may further comprise a handle, a hanging mechanism, or the like. In these examples, the handle and/or the hanging mechanism may allow a user increased mobility of the chainsaw bar shield alone or in combination with the chainsaw and/or storage of the chainsaw bar shield alone or in combination with the chainsaw.

The terms "comprising," "including," and "having," as used in the claims and specification herein, shall be considered as indicating an open group that may include other elements not specified. The terms "a," "an," and the singular form of words shall be taken to include the plural form of the same words, such that the terms mean that one or more of something is provided. The terms "at least one" and "one or more" are used interchangeably. The term "single" shall be used to indicate that one and only one of something is intended. Similarly, other specific integer values, such as "two," are used when a specific number of things are intended. The terms "preferably," "preferred," "prefer," "optionally," "may," and similar terms are used to indicate that an item, condition or step being referred to is an optional (i.e., not required) feature of the examples.

While this invention has been described with reference to examples thereof, it shall be understood that such description is by way of illustration only and should not be construed as limiting the scope of the claimed examples. Accordingly, the scope and content of the examples are to be defined only by the terms of the following claims. Furthermore, it is understood that the features of any example discussed herein may be combined with one or more features of any one or more examples otherwise discussed or contemplated herein unless otherwise stated.

What is claimed is:

1. A chainsaw bar shield comprising:

at least one bar shield arm extending from at least one securing mechanism;

wherein the at least one securing mechanism includes a pinching structure having a first engaging structure for engaging a first side of a chainsaw bar of a chainsaw and a second engaging structure for engaging a second side of the chainsaw bar of the chainsaw and a pinch point between the first engaging structure and the second engaging structure;

wherein the at least one bar shield arm is defined by a bar shield arm length and a bar shield arm width that is shorter than the bar shield arm length, wherein the bar shield arm width is perpendicular to the bar shield arm length and extends in a direction from the first engaging structure to the second engaging structure;

wherein the at least one bar shield arm is offset from and extends across the pinch point in a direction of the bar shield arm width and the at least one bar shield arm does not contact or engage the chainsaw bar and a chainsaw chain of the chainsaw when the chainsaw bar shield is secured to the chainsaw; and an end arm extending downwardly from an end of the bar shield arm length, wherein the at least one bar shield arm at least partially conceals the chainsaw chain of the chainsaw, and the end arm at least partially conceals a terminal end of the chainsaw bar and prevents the terminal end from extending therethrough when the bar shield is secured to the chainsaw.

2. The chainsaw bar shield of claim 1 wherein the at least one bar shield arm comprises one or more lips for extending around and concealing at least a portion of the chainsaw chain.

3. The chainsaw bar shield of claim 2 wherein the one or more lips form a channel at the at least one bar shield arm.

4. The chainsaw bar shield of claim 3 wherein the channel further comprises a drain aperture.

5. The chainsaw bar shield of claim 4 further comprising a reservoir extending from the drain aperture.

6. The chainsaw bar shield of claim 1 wherein the bar shield arm length is greater than a length of the chainsaw bar extending from a chainsaw housing of the chainsaw.

7. The chainsaw bar shield of claim 1 wherein the at least one bar shield arm comprises a first bar shield arm which does not contact or engage the chainsaw bar and the chainsaw chain when the chainsaw bar shield is secured to the chainsaw and the at least one bar shield arm further comprises a second bar shield arm which does not contact or engage the chainsaw bar and the chainsaw chain when the chainsaw bar shield is secured to the chainsaw.

8. The chainsaw bar shield of claim 1 wherein the first engaging structure or the second engaging structure comprises an advancing mechanism.

9. The chainsaw bar shield of claim 1 wherein the first engaging structure and the second engaging structure comprise an advancing mechanism.

10. The chainsaw bar shield of claim 1 wherein the first engaging structure and the second engaging structure include a dampening material.

11. A chainsaw bar shield comprising:

at least one bar shield arm extending from at least one securing mechanism;

wherein the at least one securing mechanism includes a pinching structure having a first engaging structure engaged with a first side of a chainsaw bar of a chainsaw and a second engaging structure engaged with a second side of the chainsaw bar of the chainsaw and a pinch point at the chainsaw bar wherein the chainsaw bar is between the first engaging structure and the second engaging structure;

wherein at least one of the first engaging structure and the second engaging structure comprises an advancing mechanism;

wherein the at least one bar shield arm is defined by a bar shield arm length and a bar shield arm width that is shorter than the bar shield arm length, wherein the bar shield arm width is perpendicular to the bar shield arm length and extends in a direction from the first engaging structure to the second engaging structure;

wherein the at least one bar shield arm is offset from and extends across the pinch point in a direction of the bar shield arm width and the at least one bar shield arm does not contact or engage the chainsaw bar and a chainsaw chain of the chainsaw when the chainsaw bar shield is secured to the chainsaw; and an end arm extending downwardly from an end of the bar shield arm length, wherein the at least one bar shield arm at least partially conceals the chainsaw chain of the chainsaw, and the end arm at least partially conceals a terminal end of the chainsaw bar and prevents the terminal end from extending therethrough when the bar shield is secured to the chainsaw.

12. The chainsaw bar shield of claim 11 wherein the bar shield arm length is greater than a length of the chainsaw bar which extends from a chainsaw housing of the chainsaw.

13. The chainsaw bar shield of claim 12 wherein the at least one bar shield arm is adjacent and above the chainsaw bar and the chainsaw chain.

14. The chainsaw bar shield of claim 12 wherein the at least one bar shield arm is adjacent and below the chainsaw bar and the chainsaw chain.

15. The chainsaw bar shield of claim 11 wherein the at least one bar shield arm comprises a first bar shield arm above and separate from the chainsaw bar and the chainsaw chain and a second bar shield arm below and separate from the chainsaw bar and the chainsaw chain.

16. The chainsaw bar shield of claim 15 wherein the at least one bar shield arm comprises one or more lips extending from the first bar shield arm, the second bar shield arm, and the end arm for substantially enclosing the chainsaw chain extending from a chainsaw housing of the chainsaw.

17. A chainsaw bar shield comprising:

an enclosure having an opening for allowing insertion of a chainsaw bar and a chainsaw chain extending from a chainsaw housing of a chainsaw into the enclosure wherein the enclosure includes a first lateral arm, a second lateral arm, a top arm, a bottom arm, and an end arm opposite the opening for substantially enclosing the chainsaw bar and the chainsaw chain extending from the chainsaw housing;

at least one securing mechanism including a pinching structure having a first engaging structure for engaging a first side of the chainsaw bar and a second engaging structure for engaging a second side of the chainsaw bar at a pinch point;

wherein the at least one securing mechanism is secured to the enclosure for separating the enclosure from the chainsaw chain when the enclosure is substantially enclosing the chainsaw bar and the chainsaw chain which extends from the chainsaw housing; and wherein the end arm extends from the top arm to the bottom arm and from the first lateral arm to the second lateral arm, and wherein the top arm and the bottom arm at least partially conceal the chainsaw chain, and the end arm at least partially conceals a terminal end of the chainsaw bar and prevents the terminal end from extending therethrough when the bar shield is secured to the chainsaw.

18. The chainsaw bar shield of claim 17 wherein the enclosure further comprises a channel extending to a drain aperture formed in the channel.

19. The chainsaw bar shield of claim 17 wherein the enclosure further comprises an extension mechanism for increasing a length of the enclosure.

20. The chainsaw bar shield of claim 19 wherein the extension mechanism is a sliding mechanism.

* * * * *